US007334787B2

(12) United States Patent
Akiyama et al.

(10) Patent No.: US 7,334,787 B2
(45) Date of Patent: Feb. 26, 2008

(54) PAPER FEEDING APPARATUS

(75) Inventors: Shigeki Akiyama, Ichinomiya (JP); Masatoshi Kokubo, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1072 days.

(21) Appl. No.: 10/394,013

(22) Filed: Mar. 24, 2003

(65) Prior Publication Data

US 2003/0184002 A1 Oct. 2, 2003

(30) Foreign Application Priority Data

Mar. 29, 2002 (JP) ..... 2002-095346

(51) Int. Cl.
*B65H 5/00* (2006.01)

(52) U.S. Cl. ..... 271/10.02; 271/10.03; 271/258.01

(58) Field of Classification Search ..... 271/10.02, 271/10.03, 258.01, 152, 154, 157, 10.05
See application file for complete search history.

(56) References Cited

U.S. PATENT DOCUMENTS

| | | | | |
|---|---|---|---|---|
| 4,455,018 | A | 6/1984 | Colglazier et al. | |
| 4,623,827 | A | 11/1986 | Ito | |
| 5,323,219 | A | 6/1994 | Hamanaka et al. | |
| 6,002,234 | A | 12/1999 | Ohm et al. | |
| 6,135,439 | A | 10/2000 | Ikeda | |
| 2004/0119224 | A1* | 6/2004 | Otsuka | 271/10.03 |

FOREIGN PATENT DOCUMENTS

| | | |
|---|---|---|
| EP | 1 080 928 A2 | 3/2001 |
| EP | 1 129 856 A1 | 9/2001 |
| EP | 1 175 011 A1 | 1/2002 |
| GB | 1 374 267 | 11/1974 |
| JP | A 3-192052 | 8/1991 |
| JP | A 5-238569 | 9/1993 |
| JP | A 2001-97601 | 4/2001 |
| JP | A 2001-142537 | 5/2001 |

* cited by examiner

*Primary Examiner*—David H Bollinger
(74) *Attorney, Agent, or Firm*—Oliff & Berridge, PLC

(57) ABSTRACT

When the sheets are taken out sheet by sheet and started to be fed, in a first predetermined section, a driving mode is set to a fixed PWM driving mode, and a DC motor is driven in response to a PWM signal of a fixed duty to perform the sheet feed operation (S110, S120). When the tip end of the fed sheet is detected by a registration sensor (S140: YES), the sheet feed operation is once stopped (S150), and the driving mode is changed to a position feedback control mode (S170). Thereafter, the sheet is fed to a registration position by a position feedback control, the sheet reaches the registration position, the sheet feed is completed (S200: YES), and the process enters the next transfer operation. The transfer operation is also performed in the position feedback control mode. When a control method is changed before/after the registration sensor in this manner, the speeding-up and noise reduction of the sheet feed operation are realized.

25 Claims, 17 Drawing Sheets

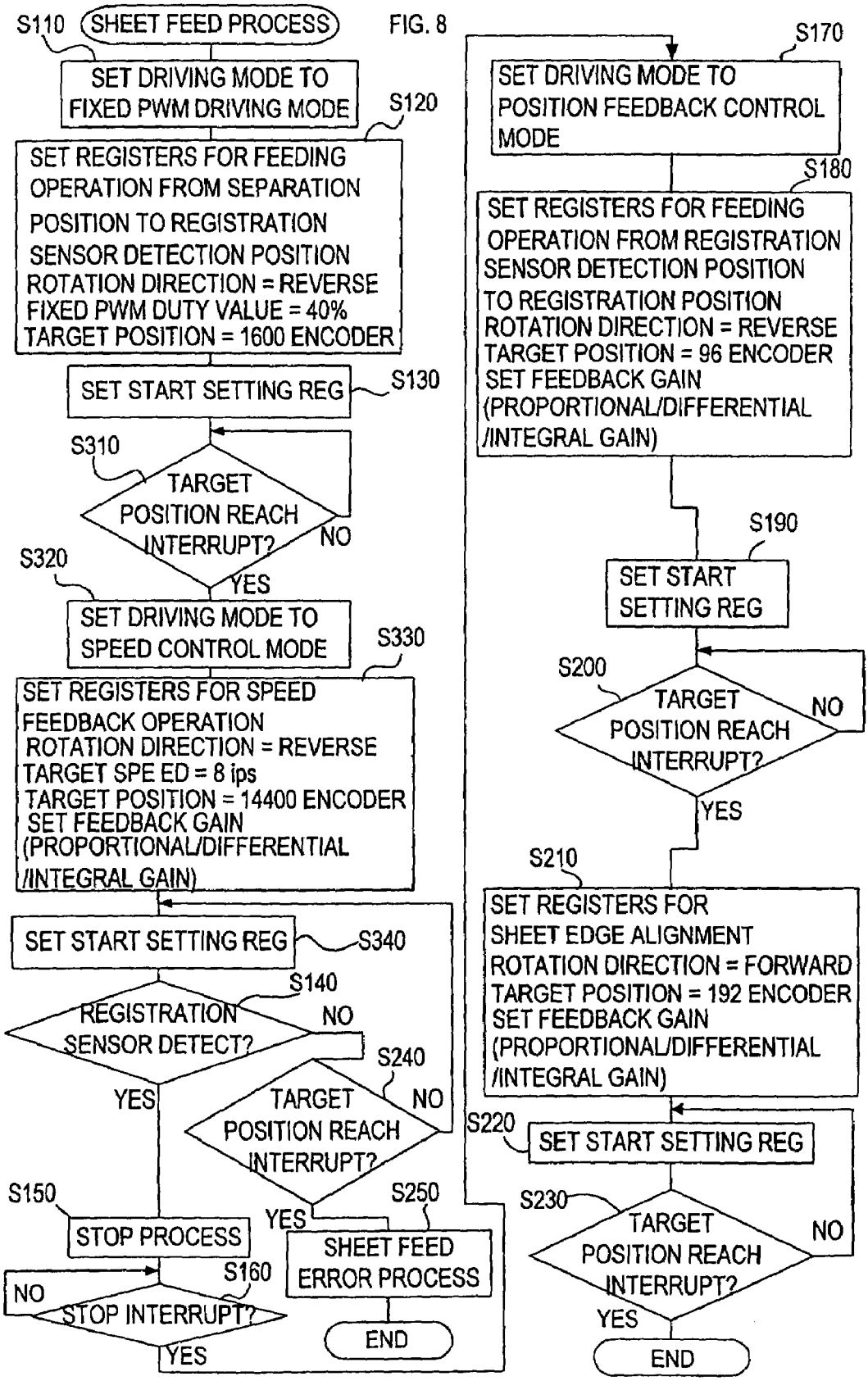
FIG. 8
S110
SHEET FEED PROCESS
SET DRIVING MODE TO FIXED PWM DRIVING MODE
S120
SET REGISTERS FOR FEEDING OPERATION FROM SEPARATION POSITION TO REGISTRATION SENSOR DETECTION POSITION
ROTATION DIRECTION = REVERSE
FIXED PWM DUTY VALUE = 40%
TARGET POSITION = 1600 ENCODER
SET START SETTING REG
S130
S310
TARGET POSITION REACH INTERRUPT?
NO
YES
S320
SET DRIVING MODE TO SPEED CONTROL MODE
S330
SET REGISTERS FOR SPEED FEEDBACK OPERATION
ROTATION DIRECTION = REVERSE
TARGET SPE ED = 8 ips
TARGET POSITION = 14400 ENCODER
SET FEEDBACK GAIN (PROPORTIONAL/DIFFERENTIAL /INTEGRAL GAIN)
SET START SETTING REG
S340
S140
REGISTRATION SENSOR DETECT?
NO
YES
S240
TARGET POSITION REACH INTERRUPT?
NO
YES
S150
STOP PROCESS
S250
SHEET FEED ERROR PROCESS
S160
STOP INTERRUPT?
NO
YES
END
S170
SET DRIVING MODE TO POSITION FEEDBACK CONTROL MODE
S180
SET REGISTERS FOR FEEDING OPERATION FROM REGISTRATION SENSOR DETECTION POSITION TO REGISTRATION POSITION
ROTATION DIRECTION = REVERSE
TARGET POSITION = 96 ENCODER
SET FEEDBACK GAIN (PROPORTIONAL/DIFFERENTIAL /INTEGRAL GAIN)
S190
SET START SETTING REG
S200
TARGET POSITION REACH INTERRUPT?
NO
YES
S210
SET REGISTERS FOR SHEET EDGE ALIGNMENT
ROTATION DIRECTION = FORWARD
TARGET POSITION = 192 ENCODER
SET FEEDBACK GAIN (PROPORTIONAL/DIFFERENTIAL /INTEGRAL GAIN)
S220
SET START SETTING REG
S230
TARGET POSITION REACH INTERRUPT?
NO
YES
END

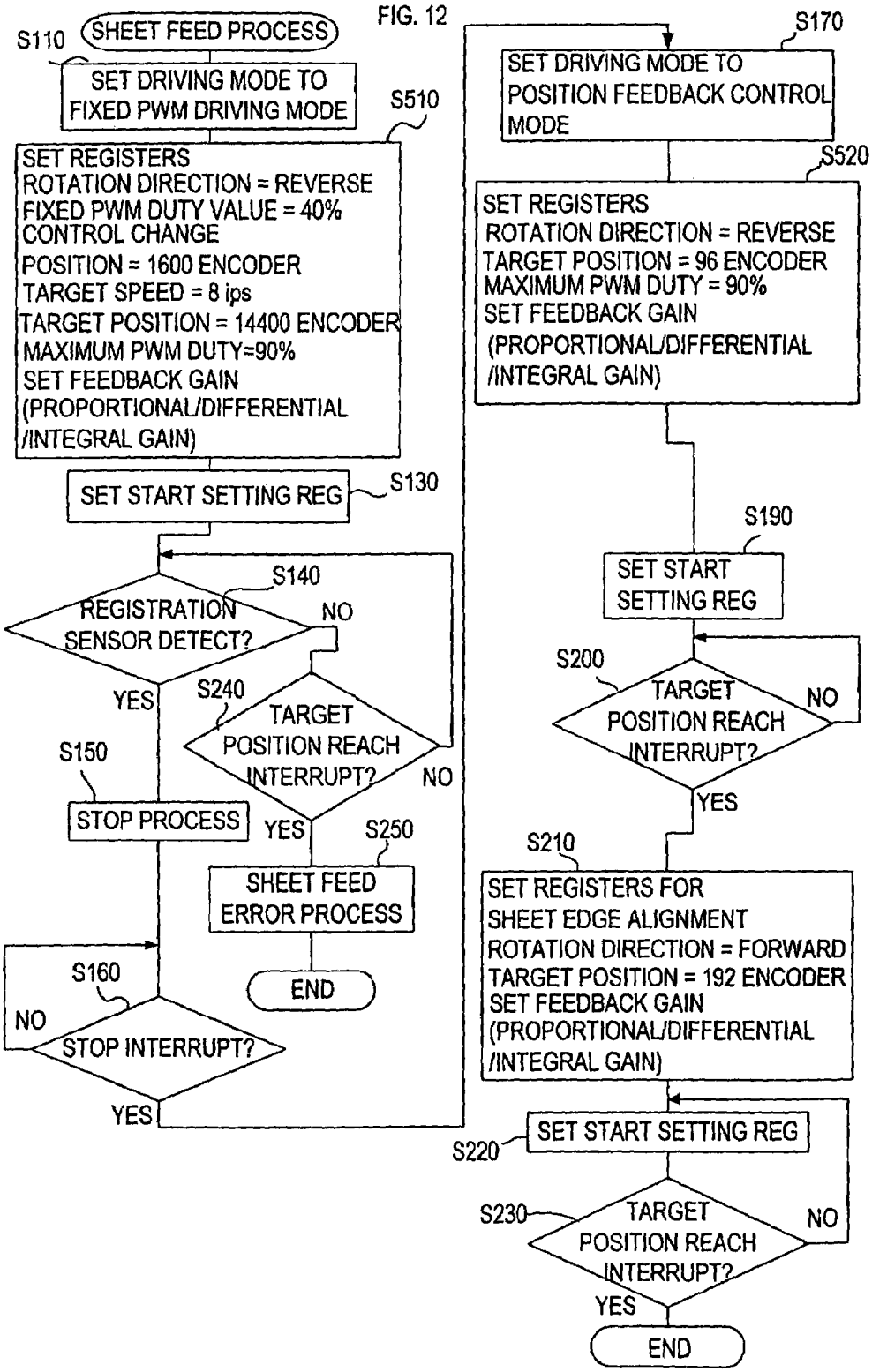
FIG. 12
SHEET FEED PROCESS
S110
SET DRIVING MODE TO FIXED PWM DRIVING MODE
S510
SET REGISTERS
ROTATION DIRECTION = REVERSE
FIXED PWM DUTY VALUE = 40%
CONTROL CHANGE
POSITION = 1600 ENCODER
TARGET SPEED = 8 ips
TARGET POSITION = 14400 ENCODER
MAXIMUM PWM DUTY=90%
SET FEEDBACK GAIN
(PROPORTIONAL/DIFFERENTIAL /INTEGRAL GAIN)
SET START SETTING REG
S130
S140
REGISTRATION SENSOR DETECT?
NO
YES
S240
TARGET POSITION REACH INTERRUPT?
NO
YES
S150
STOP PROCESS
S250
SHEET FEED ERROR PROCESS
END
S160
NO
STOP INTERRUPT?
YES
S170
SET DRIVING MODE TO POSITION FEEDBACK CONTROL MODE
S520
SET REGISTERS
ROTATION DIRECTION = REVERSE
TARGET POSITION = 96 ENCODER
MAXIMUM PWM DUTY = 90%
SET FEEDBACK GAIN
(PROPORTIONAL/DIFFERENTIAL /INTEGRAL GAIN)
S190
SET START SETTING REG
S200
TARGET POSITION REACH INTERRUPT?
NO
YES
S210
SET REGISTERS FOR SHEET EDGE ALIGNMENT
ROTATION DIRECTION = FORWARD
TARGET POSITION = 192 ENCODER
SET FEEDBACK GAIN
(PROPORTIONAL/DIFFERENTIAL /INTEGRAL GAIN)
S220
SET START SETTING REG
S230
TARGET POSITION REACH INTERRUPT?
NO
YES
END

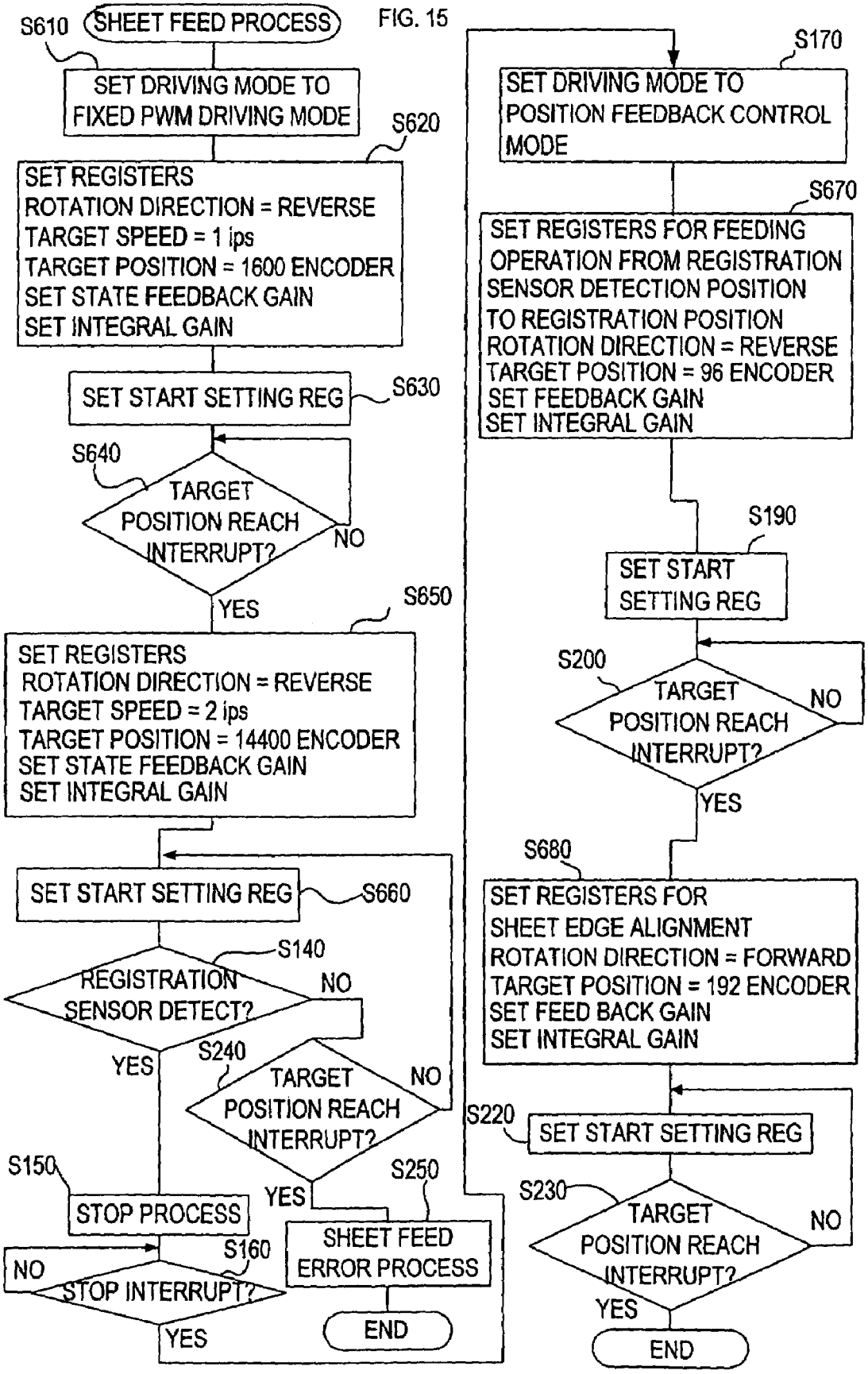
FIG. 15
SHEET FEED PROCESS
S610
SET DRIVING MODE TO FIXED PWM DRIVING MODE
S620
SET REGISTERS
ROTATION DIRECTION = REVERSE
TARGET SPEED = 1 ips
TARGET POSITION = 1600 ENCODER
SET STATE FEEDBACK GAIN
SET INTEGRAL GAIN
SET START SETTING REG
S630
S640
TARGET POSITION REACH INTERRUPT?
NO
YES
S650
SET REGISTERS
ROTATION DIRECTION = REVERSE
TARGET SPEED = 2 ips
TARGET POSITION = 14400 ENCODER
SET STATE FEEDBACK GAIN
SET INTEGRAL GAIN
SET START SETTING REG
S660
S140
REGISTRATION SENSOR DETECT?
NO
YES
S240
TARGET POSITION REACH INTERRUPT?
NO
YES
S150
STOP PROCESS
S250
SHEET FEED ERROR PROCESS
S160
NO
STOP INTERRUPT?
YES
END
S170
SET DRIVING MODE TO POSITION FEEDBACK CONTROL MODE
S670
SET REGISTERS FOR FEEDING OPERATION FROM REGISTRATION SENSOR DETECTION POSITION TO REGISTRATION POSITION
ROTATION DIRECTION = REVERSE
TARGET POSITION = 96 ENCODER
SET FEEDBACK GAIN
SET INTEGRAL GAIN
S190
SET START SETTING REG
S200
TARGET POSITION REACH INTERRUPT?
NO
YES
S680
SET REGISTERS FOR SHEET EDGE ALIGNMENT
ROTATION DIRECTION = FORWARD
TARGET POSITION = 192 ENCODER
SET FEED BACK GAIN
SET INTEGRAL GAIN
S220
SET START SETTING REG
S230
TARGET POSITION REACH INTERRUPT?
NO
YES
END

PAPER FEEDING APPARATUS

BACKGROUND OF THE INVENTION (i) Field of the Invention

The present invention relates to a sheet feeding apparatus in which sheets for printing stored in a sheet storage unit is taken out and fed out sheet by sheet by a sheet feed roller rotated by a motor.

(ii) Description of the Related Art

For example, as a sheet feeding apparatus mounted on an ink jet printer, a constitution has heretofore been known in which a sheet feed roller is brought in contact with a surface of a plurality of laminated printing sheets and rotated by a motor to feed out the printing sheet in a predetermined direction.

In this type of sheet feeding apparatus, it is conventional to use a stepping motor as the motor for rotating the sheet feed roller. Moreover, for example, when there is a sheet feed request by an input of printing job data from the outside, the motor is driven to rotate the sheet feed roller, and one of the plurality of printing sheets stored (laminated) in a predetermined storage position is taken out. This taken printing sheet is successively fed out to a registration position where sheet transfer at a printing operation is started by the sheet feed roller.

In this registration position, a transfer roller is disposed to transfer the sheet at the printing operation. After the tip ends of the printing sheets fed out by the sheet feed roller are aligned in this registration position, the printing sheets start to be transferred by the transfer roller. Moreover, while the printing sheet is transferred by the transfer roller, a desired image (printing job data) is printed on the printing sheet.

It is to be noted that a registration sensor for detecting the tip-end position of the sheet being fed is disposed in a predetermined position on a sheet feed path extending to the registration position from the storage position from which the sheet is taken out.

Therefore, after the printing sheet is removed from the storage position, the stepping motor is driven until the tip-end position of the sheet is detected. In this case, a feed amount sufficiently longer than the length of the sheet feed path extending between the storage position and registration sensor is set to a target value. Subsequently, after the detection by the registration sensor, the target feed amount is successively set in accordance with a distance, known beforehand, between the detected position and registration position, and the stepping motor is accordingly driven. As a result, when the tip end of the sheet reaches the registration position, the driving of the stepping motor stops to stop the rotation of the sheet feed roller, and thereby the sheet feed operation of the printing sheet is completed.

In recent years, there has been an increasing demand for the speeding-up of the sheet feed operation in the sheet feeding apparatus or noise reduction at a sheet feed operation. However, in the sheet feeding apparatus in which the stepping motor is used as a driving source as described above, it is very difficult to achieve both the speeding-up and noise reduction.

That is, as well known, the stepping motor rotates by each predetermined step angle in response to a pulse signal. Therefore, the rotation speed has its upper limit. When a pulse rate is increased so as to be not less than a predetermined value, the motor steps out. There is a possibility that rotation control itself becomes impossible.

Additionally, in operation principle in which the motor rotates little by little in response to the pulse signal, there is a tendency that the accelerated rotation speed results in much noise.

SUMMARY OF THE INVENTION

The present invention has been developed in consideration of the above-described problems, and an object thereof is to speed up a sheet feed operation for removing and feeding sheets from a sheet storage position sheet by sheet and to reduce noise generated at a sheet feed operation.

To attain this and other objects, according to the present invention, there is provided a sheet feeding apparatus in which a sheet feeder rotates a sheet feed roller in contact with sheets for printing by a motor to take out the sheets stored in a sheet storage unit sheet by sheet, and feeds the sheet to a predetermined registration position in which sheet transfer at a printing operation is started, and a controller controls the rotating/driving of the motor to control the operation of the sheet feeder.

Moreover, in the present invention, a DC motor is used as the motor, and an operation state detector detects operation states of the motor or motor load driven by the motor. Furthermore, a reference position detector detects that the sheet fed by the sheet feeder has reached a predetermined reference position in a sheet feed path extending to the registration position from the sheet storage unit.

Furthermore, the controller is constituted of a position control portion and a high-speed driving portion. The position control portion performs a position feedback control to rotate/drive the motor in accordance with a deviation between the position of the sheet obtained based on the operation state detected by the operation state detector and a predetermined target position in a sheet feed end section from when the reference position detector detects that the sheet has reached the reference position until the sheet reaches the registration position. On the other hand, the high-speed driving portion rotates/drives the motor without performing the position feedback control to feed the sheet at a speed higher than a feed speed at a position feed back control in a sheet feed start section from when a sheet feed request is received from the outside until the reference position detector detects that the sheet has reached the reference position.

As well known, for example, different from a stepping motor which rotates by a predetermined angle in response to each given pulse, the DC motor rotates simply, by necessary minimum direct-current power supply, and does not cause step-out phenomenon. Therefore, in general, the DC motor can rotate at the speed higher than that of the stepping motor, and noise at a rotation time is relatively low, for example, as compared with the stepping motor.

Therefore, in the present invention, the DC motor is used as the motor for rotating/driving the sheet feed roller, so that the speeding-up of the sheet feed by the sheet feeder and noise reduction at the sheet feed are realized.

Moreover, in the operation for feeding the sheet to the registration position from the sheet storage unit (hereinafter referred to also as the "sheet feed operation"), it is necessary to finally stop the sheet feed in the registration position. Therefore, in the present invention, the position feedback control is performed in the sheet feed end section. In the sheet feed start section from when the sheet is removed from the sheet storage unit until the sheet reaches the reference position, that is, the reference position is detected by the reference position detector, the motor can be rotated in various driving method as long as the sheet can be fed to the reference position.

Therefore, in the present invention, the motor is driven in driving methods other than the position feedback control in the sheet feed start section, and the sheet is fed at the speed higher than the feed speed at the position feed back control.

According to the sheet feeding apparatus of the present invention constituted in this manner, the DC motor is used as the motor for driving the sheet feed roller. Additionally, since the motor can be rotated at the high speed in the driving method other than the position feedback control in the sheet feed start section, both the speeding-up and noise reduction of the sheet feed operation can be realized.

Here, for the rotating/driving of the motor by the high-speed driving portion (in other words, the rotating/driving of the motor in the sheet feed start section), various methods can be used as long as the sheet can be fed at the speed higher than the feed speed in a case in which the position feedback control is performed. For example, in the present invention, the motor may also be driven by turning on/off a switching device disposed on an energizing path of the motor in response to a PWM signal having a preset fixed duty.

That is, a so-called open loop control is performed so that the PWM signal having the fixed duty is given. When the fixed duty is set to a larger value, the rotation speed of the motor can be increased. Additionally, when the PWM signal having the fixed duty is simply given, a desired rotation torque is not generated depending on the state of the sheet feeder or the storage state of the sheets. There is a possibility that the sheet cannot smoothly be removed from the sheet storage unit.

To solve the problem, for example, in the present invention, the high-speed driving portion may also be constituted to obtain the torque generated by the motor based on the energizing current of the motor detected by a current detector, and to perform a torque feedback control for rotating/driving the motor so that the torque coincides with a preset target torque.

The rotating/driving of the motor is controlled in this manner so that the torque obtained based on the energizing current is the target torque. Then, the torque in removing the sheet from the sheet storage unit can be stabilized, and a sheet removing function can be enhanced.

Moreover, for example, in the present invention, the high-speed driving portion may turn on/off the switching device disposed on the energizing path of the motor to rotate the motor in response to PWM signal having the preset fixed duty in a separation period from when the rotation of the sheet feed roller starts until one sheet is removed from the sheet storage unit. The high-speed driving portion may perform a speed feedback control to rotate/drive the motor so that the feed speed coincides with the target speed in accordance with a deviation between the feed speed of the sheet obtained based on the operation state detected by the operation state detector and the preset target speed in a period until the reference position detector detects that the sheet has reached the reference position after the separation period.

When the motor is driven in response to the PWM signal having the fixed duty over the whole sheet feed start section, the motor load increases and the feed speed drops depending on the state of the sheet feed path. There is a possibility that desired speeding-up effect cannot be obtained. Then, as described above, the motor is driven in response to the PWM signal having the fixed duty in the separation period in which the sheet stored in the sheet storage unit is removed. After the separation period, the motor is rotated/driven by the speed feedback control, and the sheet is fed at the desired feed speed. Therefore, it is possible to further increase the sheet feed speed.

It is to be noted that the separation period may be determined based on a period (i.e., the position of the sheet) from when the sheet feed operation is started until the sheet is fed by a predetermined amount. Alternatively, for example, the period may also be determined based on time elapsed from the sheet feed operation start, and can be determined in various methods.

Moreover, in the separation period, instead of driving the motor in response to the PWM signal having the fixed duty as described above, for example, in the present invention, the torque generated by the motor is obtained based on the energizing current of the motor detected by the current detector. The torque feedback control may also be performed to rotate/drive the motor so that the torque coincides with the preset target torque. Furthermore, after the separation period, the motor is similarly rotated/driven by the speed feedback control.

According to the above-described sheet feeding apparatus, for example, as compared with the driving of the motor by the torque feedback control over the whole sheet feed start section, the sheet can be fed at the desired feed speed after the separation period, so that the sheet feed speed can further be increased.

Here, during the driving of the motor in response to the PWM signal of the fixed duty in the above-described sheet feeding apparatus, there is a possibility that the sheet is not smoothly removed or the feed speed of the sheet becomes lower than the desired speed depending on the type of the sheet stored in the sheet storage unit.

To solve the problem, for example, in the present invention, the high-speed driving portion may change the fixed duty of the PWM signal in accordance with the type of the sheet. For example, a method of setting the fixed duty of a harder sheet to a higher value based on the hardness of the sheet is considered. When the high-speed driving portion is constituted in this manner, a more appropriate fixed duty can be set in accordance with the type of the sheet, and the desired feed speed can therefore be secured with respect to all the sheets.

In the sheet feeding apparatus, the target torque may also similarly be changed in accordance with the type of the sheet. Also in this case, for example, various methods are considered such as a method of setting the target torque to a higher value with respect to the harder sheet. As a result, it is possible to constantly secure the desired feed speed regardless of the type of the sheet.

Here, when the motor is driven in response to the PWM signal, the fixed duty is first set. Alternatively, when the motor is driven by the torque feedback control, the target torque is first fixed. Then, when the sheet is removed from the sheet storage unit, the sheet tip end is bent. There is the possibility that the sheet is not smoothly removed.

To solve the problem, according to the present invention, when the motor is driven in response to the PWM signal, for example, the duty of the PWM signal is increased to the fixed duty from an initial duty smaller than the fixed duty for a predetermined driving start period from the rotating/driving start of the motor, and the fixed duty may be held after the driving start period.

Moreover, according to the present invention, when the motor is driven by the torque feedback control, for example, the target torque is increased to a fixed torque from an initial torque smaller than the predetermined fixed torque for the predetermined driving start period from the rotating/driving start of the motor, and the fixed torque may be held after the driving start period. In this manner, the duty of the PWM signal or the target torque is gradually increased, and it is therefore possible to smoothly remove the sheet.

Additionally, a motor energizing method for changing the rotation speed of the motor in the speed feedback control so that the feed speed of the sheet coincides with the target speed can be realized, for example, by changing the value of a direct-current voltage to be applied to the motor. As a result, various methods can be used as long as the feed speed of the sheet can be controlled so as to coincide with the target speed. For example, according to the present invention, the speed feedback control may also be performed by turning on/off the switching device disposed on the energizing path of the motor in response to the PWM signal of the predetermined duty in accordance with the deviation between the feed speed of the sheet and the target speed.

Moreover, according to the present invention, a position feedback control may also similarly be performed by turning on/off the switching device disposed on the energizing path of the motor in response to the PWM signal of the predetermined duty in accordance with the deviation between the position of the sheet and the target position.

Furthermore, when the switching device disposed on the energizing path of the motor is turned on/off in response to the PWM signal to drive the motor in this manner, more preferably in the present invention, the controller may include a duty limiting portion that limits the duty of the PWM signal so that the duty does not exceed a preset upper limit value.

That is, for example, during the speed feedback control, when the sheet is jammed and cannot be fed from a certain position, and the sheet feed roller cannot therefore rotate (i.e., also the motor cannot rotate), the speed is controlled and increased to the target speed so that the duty of the PWM signal is increased. As a result, although the motor does not rotate, there is a possibility that an excessively large current flows through the motor.

Therefore, according to the present invention, the duty is controlled not to exceed the upper limit value, and it is thereby possible to prevent generation of problems that the excessively large current flows through the motor and the motor itself burns out and that various driver and power source circuits for driving the motor are destroyed.

Additionally, to realize the sheet feeding apparatus of the present invention, at least two control (driving) portions need to be prepared: position control portion that drives the motor by the position feedback control in the sheet feed end section; and high-speed driving portion that drives the motor by a driving method in which the sheet can be fed at the speed higher than the speed of the position feedback control in the sheet feed start section.

For example, in a constitution in which the speed feedback control is performed by a PID control in the sheet feed start section and the position feedback control is performed by the PID control in the sheet feed end section, control mechanisms (controllers constituted in a PID control mechanism) for performing the controls arc necessary.

Therefore, according to the present invention, the controller in the sheet feeding apparatus may include: an estimating portion that estimates the state of the sheet feeder based on the operation state detected by the operation state detector and a main control signal outputted to the motor; a first control signal generation portion that generates a first control signal based on a deviation between a predetermined control target value to control the operation of the sheet feeder and the operation state detected by the operation state detector or the state estimated by the estimating portion; and a main control signal generation portion that generates a main control signal based on the first control signal and a second control signal generated based on the state estimated by the estimating portion. In an example, for example, the estimating portion can be realized by a so-called observer for estimating another state amount based on an available state amount.

Moreover, in this case, the main control signal generation portion generates the main control signal for performing the position feedback control in the sheet feed end section, and generates the main control signal for rotating/driving the motor without performing the position feedback control to feed the sheet at the speed higher than the feed speed at a position feed back control in the sheet feed start section.

With the controller constituted in this manner, the speed feedback control and the position feedback control can be constituted with one control mechanism. For example, the control is performed based on the state (e.g., rotation angular speed of the motor) estimated by the estimating portion at the speed feedback time, and the control can be performed based on the detected result of the operation state detector at the position feed back control.

Therefore, according to the sheet feeding apparatus of the present invention, it is not necessary to prepare two (or more) types of control mechanisms in accordance with the controls performed in the sheet feed start and end sections. The constitution of the controller can be simplified. Additionally, the whole constitution of the sheet feeding apparatus can be simplified and reduced in cost.

Next, the sheet feeding apparatus according to the present invention further includes: a transfer roller rotated by a driving force of the motor to transfer the sheet fed to the registration position by the sheet feed roller from the registration position so that a printing operation is performed; and a driving force transmission portion that transmits rotation of the motor in a predetermined rotation direction for sheet feed to the sheet feed roller to rotate the sheet feed roller, and that transmits the rotation of the motor in a rotation direction for transfer reverse to the rotation direction for sheet feed to the transfer roller to rotate the transfer roller and to stop the rotation from being transmitted to the sheet feed roller. Furthermore, during the printing operation after the sheet is fed to the registration position, the controller rotates the motor in the rotation direction for transfer to control the sheet transfer.

That is, both the sheet feed roller and transfer roller can be rotated/driven by the common motor. The motor is rotated in the rotation direction for sheet feed to feed the sheet to the registration position, and the motor is rotated in the rotation direction for transfer reverse to the rotation direction for sheet feed to transfer the sheet from the registration position. Moreover, the rotation direction is changed by the controller.

Furthermore, in this case, according to the present invention, for the changing of the rotation direction by the controller, more preferably, the rotation direction may continuously be changed to the rotation direction for transfer from the rotation direction for sheet feed.

That is, when the motor being rotated in the rotation direction for sheet feed is rotted in the rotation direction for transfer, a control for once stopping the motor rotation is not performed. Additionally, a stop necessarily caused at a moment when the rotation direction changes does not mean that "the motor rotation is stopped" as mentioned herein.

When the rotation direction is continuously changed, it is possible to further speed up a series of flow of the sheet till the sheet transfer from the sheet feed operation.

BRIEF DESCRIPTION OF THE DRAWINGS

Embodiments of the present invention will be described hereinafter with reference to the drawings, in which:

FIG. 8 is a flowchart showing the sheet feed process according to the second embodiment;

FIG. 12 is a flowchart showing the sheet feed process according to the fourth embodiment;

FIG. 15 is a flowchart showing the sheet feed process according to the fifth embodiment;

DETAILED DESCRIPTION OF PREFERRED EMBODIMENTS

Preferred embodiments of the present invention will be described hereinafter with reference to the drawings.

First Embodiment

Figure 1:
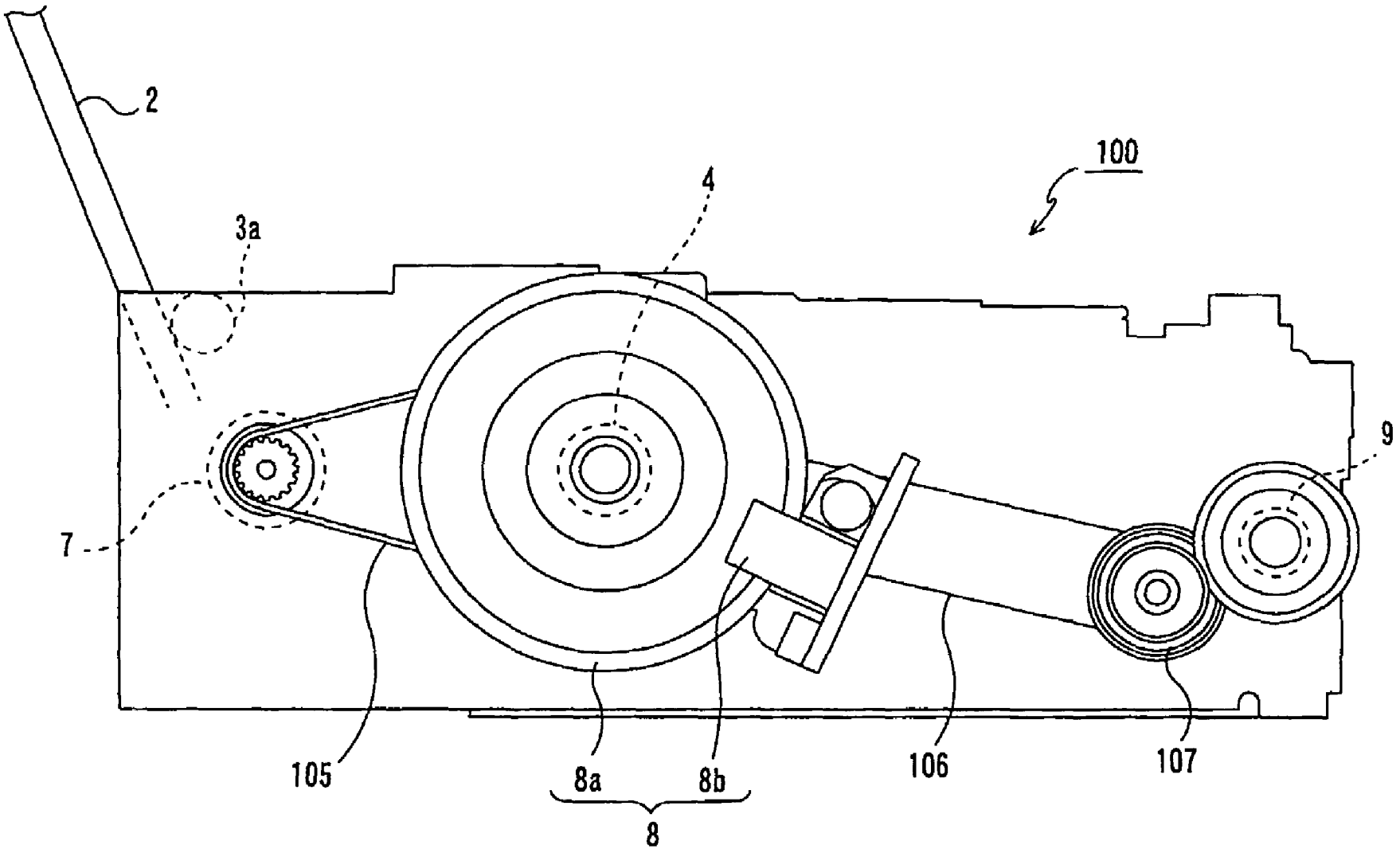
FIG. 1 is a side view of a printer according to the present embodiment.
Figure 2:
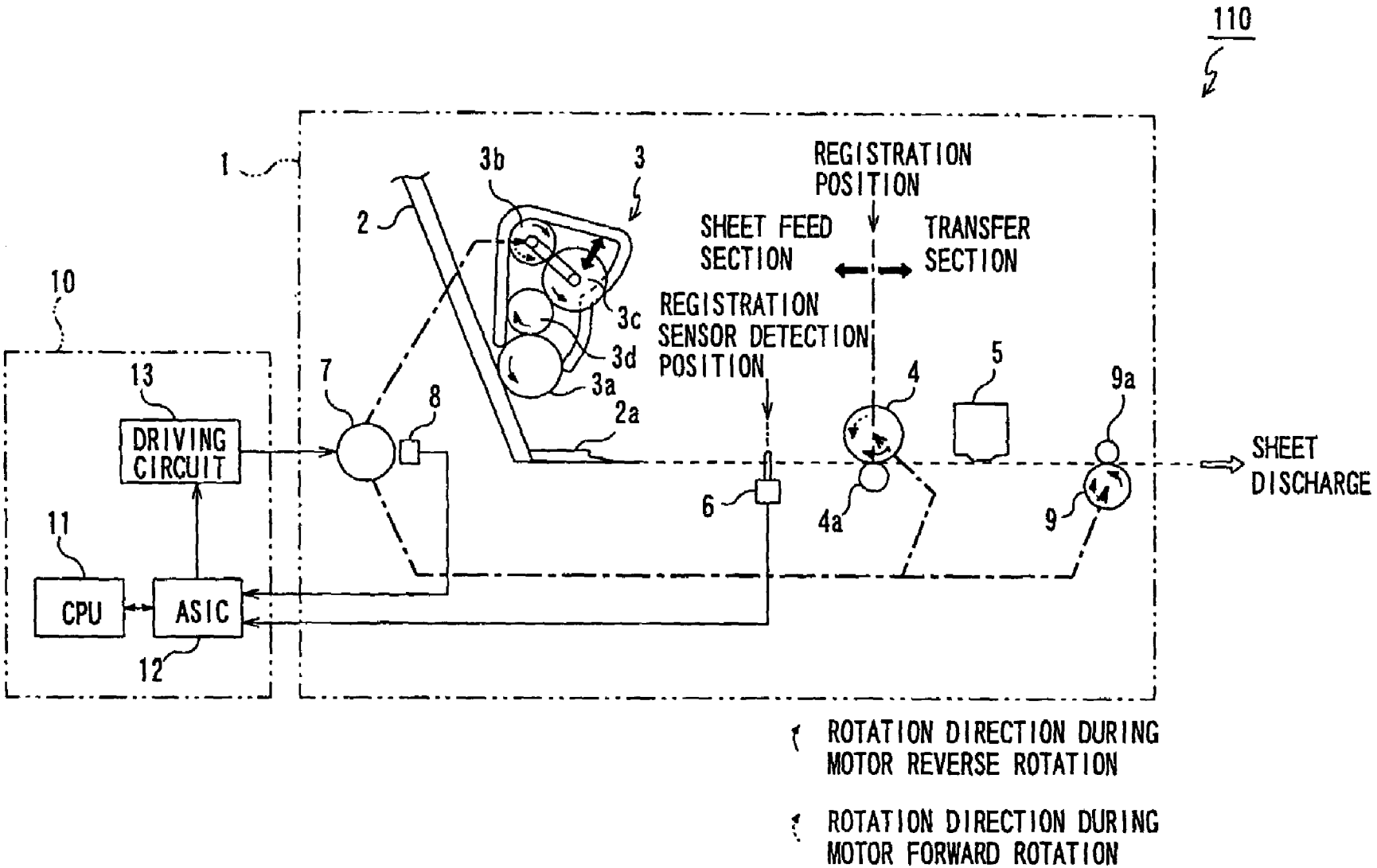
FIG. 2. is an explanatory view showing a schematic constitution of a sheet feeding apparatus mounted on the printer of the present embodiment.

First, the schematic constitution of a printer according to the present embodiment will be described with respect to FIGS. 1 and 2. FIG. 1 is a side view of a printer 100 to which the present invention is applied, and FIG. 2 is an explanatory view showing the schematic constitution of a sheet feeding apparatus 110 mounted on the printer 100 of the present embodiment.

As shown in FIG. 1, the printer 100 of the present embodiment mainly includes: a sheet storage plate 2 which is a sheet storage unit for laminating and storing sheets for printing; a sheet feed roller 3*a* which takes out and feeds out the sheets stored in the sheet storage plate 2 sheet by sheet; a transfer roller 4 which transfers the sheet fed by the sheet feed roller 3*a* at a printing operation; a sheet discharge roller 9 which assists the transfer roller in transferring the sheet during the printing operation and discharges the sheet after the end of the printing operation; a line feed (LF) motor 7 which is a rotating/driving source for the sheet feed roller 3*a*, transfer roller 4, and sheet discharge roller 9; and a rotary encoder (hereinafter referred to simply as the "encoder") 8 including a rotary slit plate 8*a* and photo interrupter 8*b* which rotate together with the rotation of the transfer roller 4. It is to be noted that the LF motor 7 is a DC motor.

The LF motor 7 rotates the transfer roller 4 and rotary slit plate 8*a* via a belt 105 extended between the transfer roller 4 and driving pulley (not shown) for driving the transfer roller. The motor also rotates the sheet discharge roller 9 via a belt 106 extended between the driving pulley (not shown) and idle roller 107, and the idle roller 107. Furthermore, the rotation of the LF motor 7 is transmitted to the sheet feed roller 3*a* via a driving force transmission mechanism (not shown), so that the sheet feed roller 3*a* is rotated.

It is to be noted that a pinch roller 4*a* is pressed in contact with the transfer roller 4 and a spur 9*a* is pressed in contact with the sheet discharge roller 9. The sheet is transferred/discharged through these passing press-contact points, and this will be described later with reference to FIG. 1.

The encoder 8 is constituted to output a pulse signal every time the rotary slit plate 8*a* rotates by a predetermined angle. Slits (not shown) are formed at predetermined intervals along a circumference in the plate. This rotary slit plate 8*a* rotates coaxially with the transfer roller 4, the transfer roller 4 is rotated by the LF motor 7, and the rotation of the LF motor 7 is further transmitted also to the sheet feed roller 3*a*. Therefore, when the pulse signals from the encoder 8 are detected/counted, it is possible to detect not only the rotation amount of the LF motor 7 but also the rotation amount of the transfer roller 4 or sheet feed roller 3*a* and the movement amount of the sheet fed/transferred by each roller 3*a* or 4.

Next, the sheet feeding apparatus mounted on the printer 100 will be described with reference to FIG. 2. It is to be noted that the sheet feeding apparatus 110 of FIG. 2 schematically shows the printer 100 shown in FIG. 1 in detail from viewpoints of the feeding/transferring/discharging of the sheets. Therefore, in FIG. 2, the same constituting elements as those shown in FIG. 1 are denoted with the same reference numerals as those in FIG. 1, and the description thereof is not repeated.

As shown in FIG. 2, the sheet feeding apparatus 110 of the present embodiment is mainly constituted of: a sheet feed/transfer mechanism 1; and a sheet feed control apparatus 10 including a CPU 11, application specific integrated circuit (ASIC) 12, and driving circuit 13.

In the sheet feed/transfer mechanism 1, first a sheet separation mechanism 3 takes out and feeds out the sheets stored in a laminated state in the sheet storage plate 2 sheet by sheet. Moreover, a bank portion (separation portion) 2*a* is disposed in the lowermost portion of the sheet storage plate 2.

In the constitution of the sheet separation mechanism 3, the sheet feed roller 3*a* contacts the uppermost surface of the laminated sheets, and the sheet feed roller 3*a* rotates counterclockwise so that the sheet having the uppermost surface is fed toward the bank portion 2*a*. Moreover, the mechanism includes: a sun gear 3*b* which receives a rotating/driving force transmitted from the LF motor 7 via a driving force transmission mechanism (not shown); a planetary gear 3*c* constituted to be movable along the periphery of the sun gear 3*b*; and a driven gear 3*d* which is rotated by the planetary gear 3*c*.

Moreover, when the LF motor 7 rotates in reverse, the sun gear 3*b* receives the rotating/driving force to rotate in a clockwise direction, and the planetary gear 3*c* receives this force to move to the position shown in FIG. 2. Thereby, since the planetary gear 3*c* meshes with the driven gear 3*d*, the rotating/driving force of the sun gear 3*b* in the clockwise direction is transmitted to the sheet feed roller 3*a* via the planetary gear 3*c* and driven gear ad. As a result, the sheet feed roller 3*a* rotates in the counterclockwise direction, removes one sheet from the sheets laminated in the sheet storage plate 2, and feeds the sheet toward the bank portion 2*a*.

On the other hand, when the LF motor 7 rotates forwards, the sun gear 3*b* receives the rotating/driving force to rotate counterclockwise. Therefore, the planetary gear 3*c* moves in a disengaging direction from the driven gear 3*d*. Thereby, the rotating/driving force of the LF motor 7 is not transmitted to the sheet feed roller 3*a*, and the sheet feed roller 3*a* does not rotate.

Moreover, as described with reference to FIG. 1, the rotating/driving force of the LF motor 7 is transmitted to both the transfer roller 4 and sheet discharge roller 9. At this time, while the LF motor 7 is rotating in reverse (i.e., while the sheet feed roller 3*a* is rotating), the transfer roller 4 rotates clockwise and the sheet discharge roller 9 rotates counterclockwise. Furthermore, while the LF motor 7 is rotating forwards (the sheet feed roller 3*a* is not rotating), the transfer roller 4 rotates counterclockwise and the sheet discharge roller 9 rotates clockwise.

Additionally, a pinch roller 4*a* is in press contact with the transfer roller 4, and a spur 9*a* is in press contact with the sheet discharge roller 9. The sheet is passed through the respective press-contact points, printed by a printing head 5 disposed between the transfer roller 4 and sheet discharge roller 9, and discharged from the press-contact point of the sheet discharge roller 9 with the spur 9*a*.

It is to be noted that the rotation direction for reversing the LF motor 7 corresponds to a rotation direction for sheet feed according to the present invention, and the rotation direction for rotating the LF motor 7 forwards corresponds to a rotation direction for transfer according to the present invention. Moreover, in FIG. 2, the driving force transmission portion according to the present invention is constituted by the respective belts 105, 106 and idle roller 107 for transmitting the rotating/driving force of the LF motor 7 to the transfer roller 4 and sheet discharge roller 9, and the driving force transmission mechanism (not shown) and respective gears 3*b* to 3*d* for transmitting the rotating/driving force of the LF motor 7 to the sun gear 3*b*.

The bank portion (separation portion) 2*a* supports the lower end of the sheet laminated in the sheet storage plate 2. When the sheet feed roller 3*a* rotates, one sheet is separated and removed from the sheets laminated on the bank portion 2*a*. Subsequently, the removed sheet is fed rightward in a path shown by a broken line in FIG. 2. It is to be noted that in the following description, the section in which the sheet is removed from the sheet storage plate 2 and reaches the press-contact point (registration position) of the transfer roller 4 with the pinch roller 4*a* is referred to as a sheet feed section. The section in which the sheet is transferred from the registration position and the printing operation by the printing head 5 ends is referred to as a transfer section.

Moreover, a registration sensor 6 for detecting the tip-end position of the sheet is disposed in a portion extending to the registration position from the bank portion 2*a* in the sheet feed section. The registration sensor detection position detected by the registration sensor 6, and a detection signal by the registration sensor 6 is inputted into the ASIC 12. Furthermore, the pulse signal from the encoder 8 is also inputted into the ASIC 12.

It is to be noted that the section in which the sheet is removed from the sheet storage plate 2 and fed to the registration sensor detection position in the sheet feed section. The section in which the sheet reaches the registration position from the registration sensor detection position corresponds to the sheet feed end section of the present invention.

Figure 3:
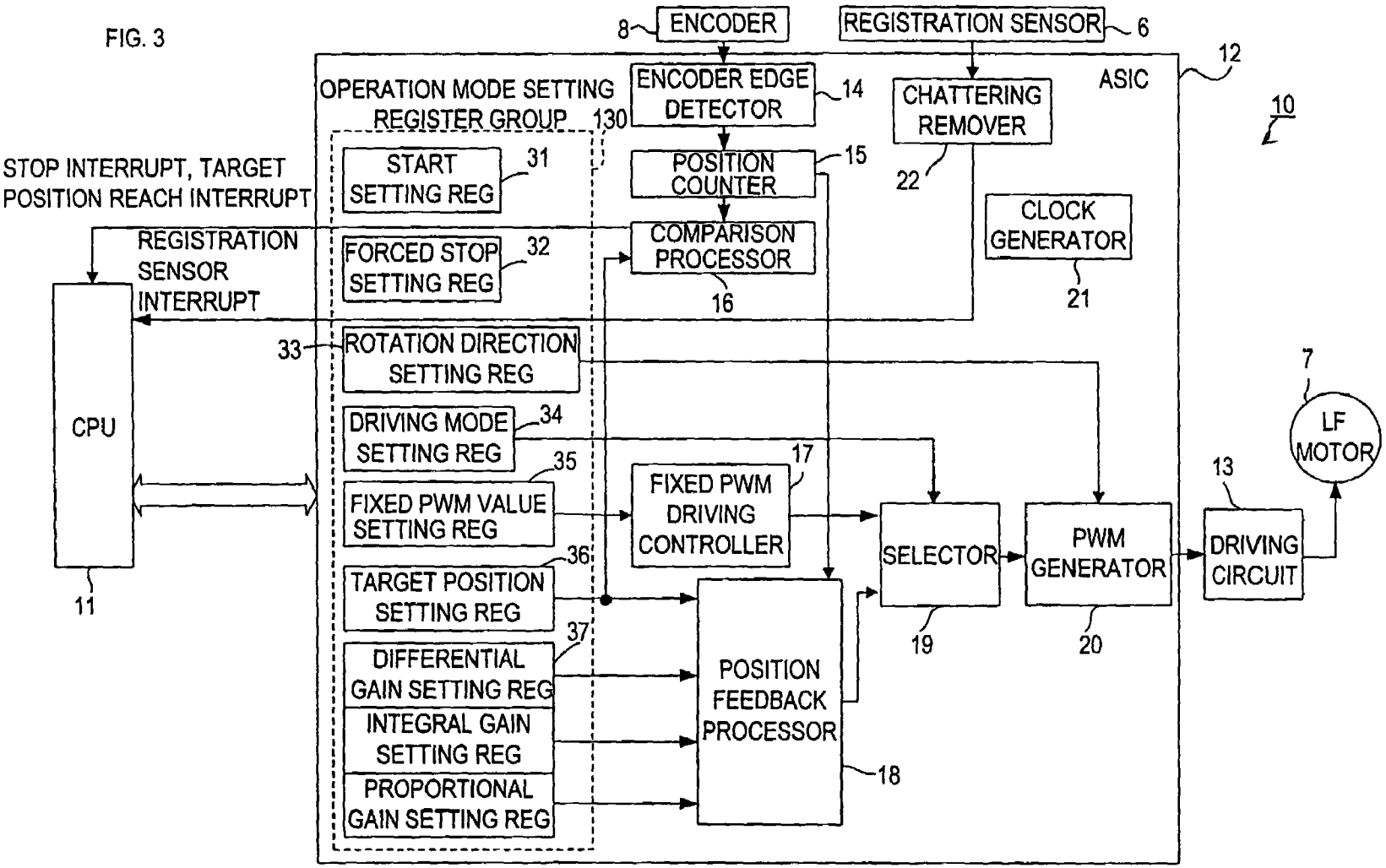
FIG. 3 is a block diagram showing the schematic constitution of a sheet feed control apparatus according to a first embodiment.

Next, in the above-described sheet feeding apparatus 110, the sheet feed control apparatus 10 that controls the operation of the sheet feed/transfer mechanism 1 will be described with reference to FIG. 3. FIG. 3 is a block diagram showing the schematic constitution of the sheet feed control apparatus 10. As shown in FIG. 8, the sheet feed control apparatus 10 is constituted of: the CPU 11 for overall controlling the printer 100; the ASIC 12 for generating a PWM signal to control the rotation speed or direction of the LF motor 7; and the driving circuit 13 for driving the LF motor 7 based on the PWM signal generated by the ASIC 12.

Figure 5:
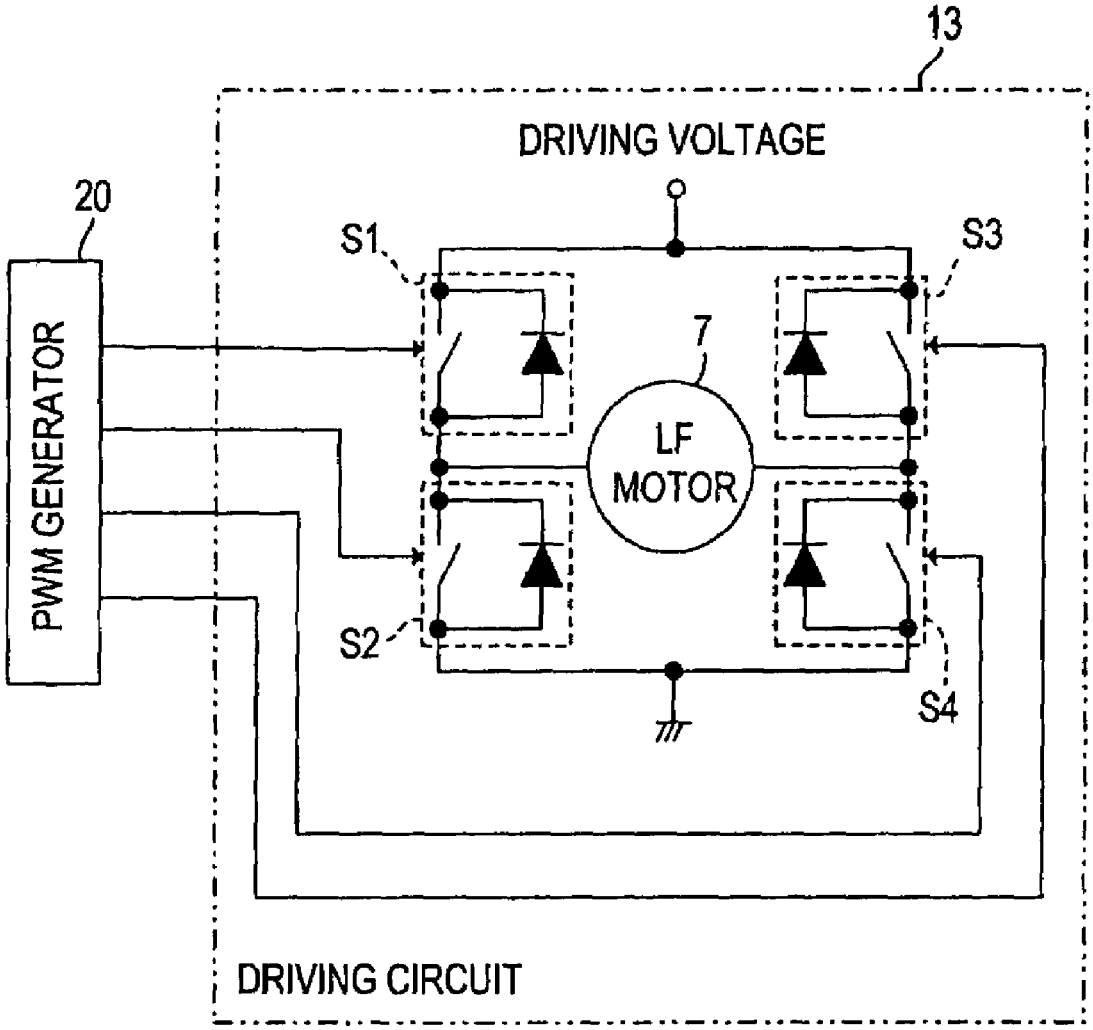
FIG. 5 is a circuit diagram showing the schematic constitution of a driving circuit.

The driving circuit 13 is shown in detail in FIG. 5. Four switching devices S1 to S4 constitute an H bridge circuit. When the respective switching devices S1 to S4 of the H bridge circuit are controlled to turn on/off based on the PWM signal generated by a PWM generator 20 in the ASIC 12, the LF motor 7 is driven. It is to be noted that semiconductor switching devices such as FET are used in the respective switching devices S1 to S4.

A register group 130 in which various parameters for use in controlling the LF motor 7 are stored is disposed in the ASIC 12. This register group 130 is constituted of: a start setting register 31 for starting the LF motor 7; a forced stop setting register 32 for forcibly stopping the rotation of the LF motor 7; a rotation direction setting register 33 for setting the rotation direction of the LF motor 7; a driving mode setting register 34 for setting a control method for driving the LF motor 7; a fixed PWM value setting register 35 for setting the duty of the PWM signal generated by the PWM generator 20; a target position setting register 36 for setting the target feed/transfer amount (hereinafter referred to simply as the "target position") of the sheet in the pulse number of the pulse signal of the encoder 8; and a gain setting register 37 for setting differential, integral, and proportional gains for use in feedback computation during the feedback control of the rotation speed of the LF motor 7 (position feedback control in the present embodiment).

An encoder edge detector 14 detects the edge (e.g., a rising edge and/or a falling edge) of the pulse signal fetched from the encoder 8, and a position counter 15 counts the detected edge to detect the position of the sheet being fed in the sheet feed section or transferred in the transfer section as a count value.

A comparison processor 16 compares the target position of the sheet set in the target position setting register 36 with the existing position of the sheet detected by the position counter 15 to determine whether or not the sheet has reached the target position. The processor outputs an interrupt signal (target position reach interrupt) to the CPU 11, when determining that the sheet has reached the target position. Even when the edge is not counted up by the position counter 15 within a predetermined time, the processor determines the stopping and outputs the interrupt signal (stop interrupt) to the CPU 11.

A fixed PWM driving controller 17 outputs a fixed PWM duty value which is set in the fixed PWM value setting register 35. A position feedback processor 18 performs computation processing, for example, based on a PID control, and calculates proportional, integral, and differential components from the deviation between the target position set in the target position setting register and the count value of the position counter 15. The processor uses the respective gains (set in the gain setting register 37) to sum/compute the components in order to stop the sheet in the target position with good precision. Subsequently, the processor outputs the duty value of the PWM signal in accordance with the result of this summing computation.

A selector 19 selects either the PWM duty value from the fixed PWM driving controller 17 or the PWM duty value from the position feedback processor 18 in accordance with the driving mode set in the driving mode setting register 34 and outputs the value to the PWM generator 20. Subsequently, the PWM generator 20 generates the PWM signal in accordance with the PWM duty value inputted from the selector 19 and the rotation direction set in the rotation direction setting register 33.

A clock generator 21 generates a clock signal which has a period sufficiently shorter than that of the pulse signal from the encoder 8, and supplies the signal to each component in the ASIC 12. It is to be noted that the detection signal from the registration sensor 6 is inputted into the CPU 11 via a chattering remover 22 constituted, for example, of a low pass filter. That is, the registration sensor 6 detects that the tip end of the sheet has reached the registration sensor detection position, and then outputs a registration sensor interrupt signal to the CPU 11.

Figure 4:
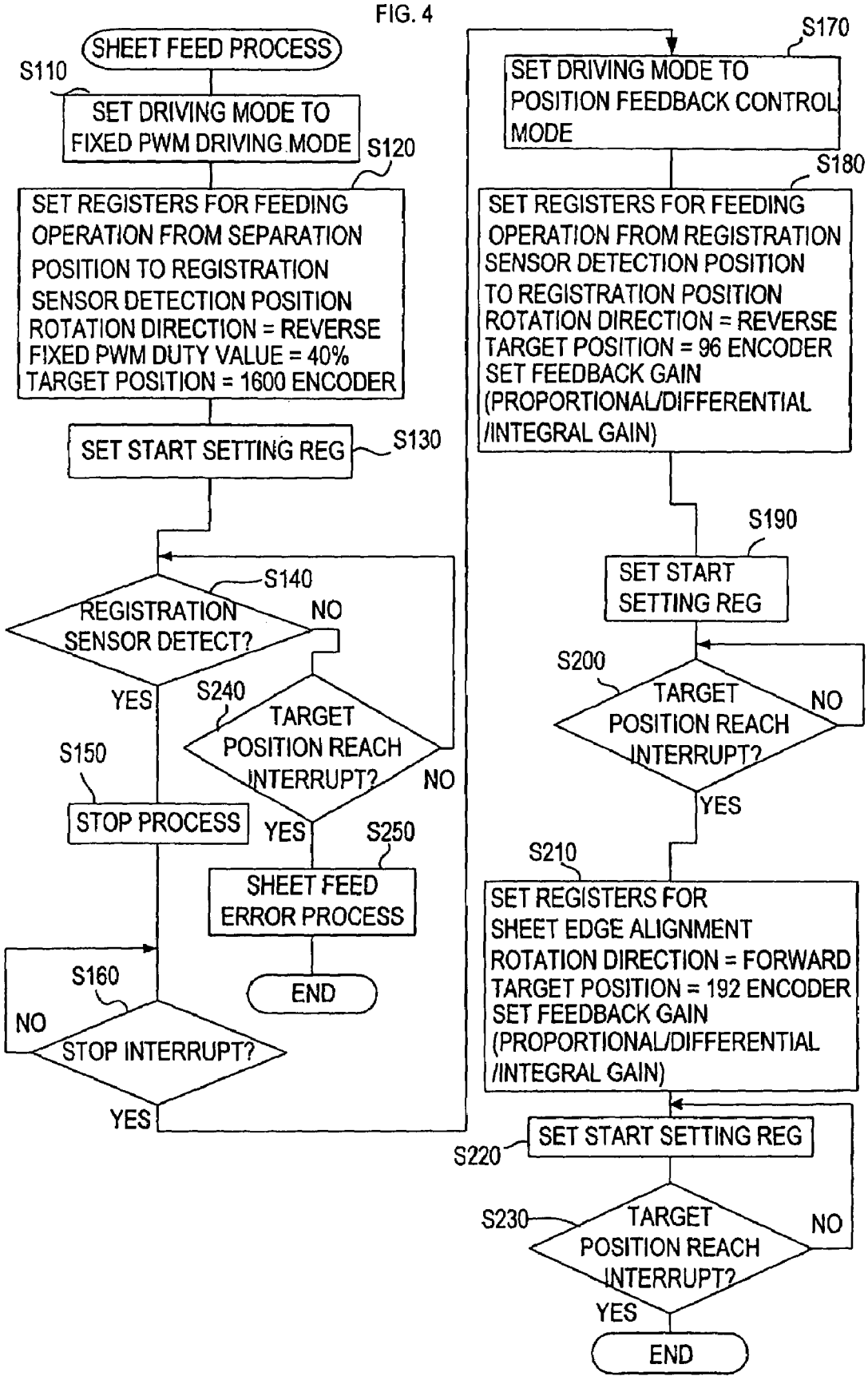
FIG. 4 is a flowchart showing a sheet feed process according to the first embodiment.

In the sheet feed control apparatus 10 of the present embodiment constituted as described above, a process of taking out the sheet stored in the sheet storage plate 2 to feed the sheet in the sheet feed section or to transfer the sheet in the transfer section (hereinafter referred to collectively as the "sheet feed process") will be described with reference to FIG. 4. FIG. 4 is a flowchart showing the sheet feed process which is performed by the CPU 11.

When this process is started, first in step (hereinafter abbreviated as "S") 110, the driving mode setting register 34 in the ASIC 12 is set to a fixed PWM driving mode. In this "fixed PWM driving mode", the PWM signal of the fixed PWM duty value set in the fixed PWM value setting register 35 is generated and outputted toward the motor 7 to drive the motor 7. It can be said that the motor is driven by a so-called open loop control in this mode.

Subsequently, in S120, the register necessary for removing (separating) the sheet from the sheet storage plate 2 and feeding the sheet to the registration sensor detection position is set. The rotation direction setting register 33 is set to the reverse rotation, the fixed PWM value setting register 35 is set to a duty value of 40%, and further the target position setting register 36 is set to 1600 encoder counts (i.e., the position in which the counts of the edges of the pulse signal from the encoder 8 are 1600 counts). This value is a sufficiently allowable value as compared with the feed amount for feeding the sheet to the registration sensor detection position. Therefore, there is no possibility that the sheet reaches the target position to stop, although the sheet does not reach the registration sensor position.

Subsequently in S130, when the start setting register 31 is set, the rotation of the LF motor 7 and the feeding of the sheet are started. After the sheet feed start, in S140, it is determined whether or not the registration sensor 6 has detected the tip end of the sheet. When the tip end is detected, in S150 a stop process is performed, and the forced stop setting register 32 is set. Thereafter, it is confirmed that the stopping of the LP motor 7 is detected by the stop interrupt signal from the ASIC 12 (S160: YES), and the process shifts to S170.

On the other hand, when the tip end is not detected by the registration sensor 6, in S140 negative determination is performed. It is determined in S240 whether or not the sheet has reached the target position (1600 encoder counts). This determination is performed based on the target position reach interrupt from the ASIC 12. When there is not any interruption, the process returns to S140. When there is the interruption, S250 is determined to have a sheet feed error, some process is done (e.g., it is informed that abnormality has been generated), and this process is ended.

After the sheet is fed to the registration sensor detection position, in S170 the driving mode setting register 34 is set to a position feedback control mode, and the process advances to S180 to set the register necessary for feeding the sheet to the registration position from the registration sensor detection position. The rotation direction setting register is set to the reverse rotation (rotation in the rotation direction for sheet feed), the target position is set to 96 encoder counts, and the gain setting register 37 is set.

After the register setting in S180, S190 the start setting register is set again to start the rotation of the LFE motor 7. Subsequently in S200, in the same manner as in S240, it is determined whether or not the sheet has reached the target position (96 encoder counts herein). Subsequently, when the sheet reaches the target position (i.e., the target position reach interrupt from the: ASIC 12 is inputted), the process shifts to S210. At this time, the sheet reaches the registration position, and the sheet feed operation shifts to the transfer operation.

In S210, various necessary register settings are performed in order to perform the transfer operation (sheet head alignment). In the sheet head alignment herein, when the sheet fed to the registration position is printed by the printing head 5, the sheet is preliminarily transferred to a predetermined position in the vicinity of the printing head 5. That is, the sheet fed in the sheet feed section is transferred to the predetermined position in the vicinity of the printing head 5 by the sheet head alignment, and the printing operation is actually started from this position.

For setting items, the rotation direction setting register 33 is set to forward rotation (rotation in the rotation direction for transfer), the target position setting register 36 is set to 192 encoder counts, and further the gain setting register 37 is set After these registers have been set, in S220 the start setting register 32 is set to start the driving of the LF motor 7. Subsequently, in S230, in the same manner as in S200, it is determined whether or not the sheet has reached the target position (192 encoder counts). When the sheet has reached the position (there is the target position reach interrupt), this sheet feed process ends.

That is, in the sheet feed process, the sheet stored in the sheet storage plate 2 is taken out, fed to the registration position, and transferred to the predetermined position from the registration position.

As described above in detail, in the sheet feed control apparatus 10 of the present embodiment, the CPU 11 sets the register group 130 in the ASIC 12, and the ASIC 12 generates the signal for driving the LF motor 7 (the PWM signal herein) in accordance with the set content and outputs the signal to the driving circuit 13. Subsequently, the operation of the H bridge circuit in the driving circuit 13 is controlled in response to the PWM signal, and power is supplied to the LF motor 7 in accordance with the PWM value from the fixed PWM driving controller 17 or position feedback processor 18.

Subsequently, in the present embodiment, after the sheet is separated, the LF motor 7 is driven to the registration sensor detection position by the PWM signal of the fixed duty, and driven to the registration position from the registration sensor detection position by the position feedback control. Also during the transfer from the registration position for the sheet head alignment, the LF motor 7 is driven by the position feedback control.

Therefore, in the sheet feeding apparatus 110 of the present embodiment constituted in this manner, first the DC motor is used in the LF motor 7 which is a driving source. Therefore, the speeding-up of the sheet feed operation and noise reduction at the sheet feed operation are realized, for example, as compared with the related-art sheet feeding apparatus in which the stepping motor is used. Moreover, the LF motor 7 is driven to the registration position from the registration sensor detection position by the position feedback control, but is driven to the registration sensor detection position from a sheet separation time by the PWM signal of the fixed duty. When the duty is raised, the desired speed can be secured. Also in this respect, further speeding-up can be realized.

Figure 6:
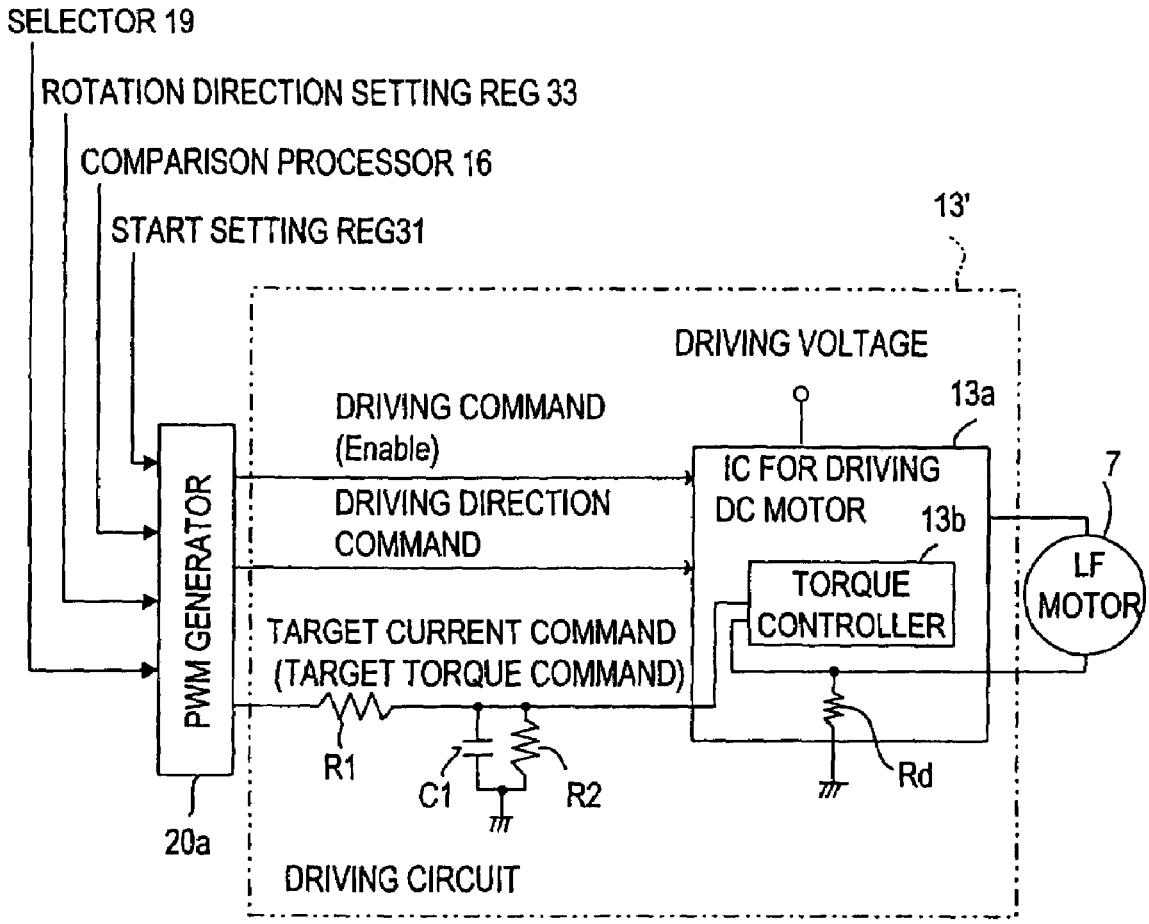
FIG. 6 is a circuit diagram showing the schematic constitution of the driving circuit.

Additionally, in the present embodiment, the driving circuit 13 constituted by the H bridge circuit as shown in FIG. 5 is used, but the circuit is not limited, and a driving circuit may also be used as shown in FIG. 6.

A driving circuit 13' detects the energizing current of the LF motor 7 as the voltage of a current detection resistance Rd to detect the torque of the LF motor 7. A torque controller 13*b* in an IC for driving the DC motor 13*a* is constituted to generate the control signal for controlling the energizing of the LF motor 7 so that the detected torque coincides with a target torque command, In other words, a torque feedback control is performed so that the energizing current of the LF motor 7 coincides with a target current command in order to control the torque of the LF motor 7 to be a constant torque.

Additionally, when the driving circuit 13' is used instead of the driving circuit 13 of FIG. 5, it is necessary to use a PWM generator 20*a* for inputting/outputting the signal as shown in FIG. 6 instead of the PWM generator 20 in the ASIC 12. That is, the PWM generator 20*a* outputs the PWM signal based on the PWM value from the selector 19, and outputs a driving direction (direction to rotate the LF motor 7) command in accordance with the set value of the rotation direction setting register 93. The generator further outputs a driving command indicating whether or not to energize the LF motor 7 in accordance with the signal from the comparison processor 16 and the input from the start setting register 31.

The target torque command (target current command) is obtained, when the PWM signal from the PWM generator 20*a* is integrated by an integration circuit constituted of resistances R1, R2, and capacitor C1. It is to be noted that the inside (not shown) of the IC for driving the DC motor 13*a* is formed of the H bridge circuit similar to that of FIG. 5. Finally, the switching operation of the switching device constituting the H bridge circuit is controlled based on the control signal from the torque controller 13*b*.

With the use of the driving circuit 13' constituted in this manner, as compared with the driving (switching control) of the driving circuit 13 of FIG. 5 simply in response to the PWM signal, the ASIC 12 does not change, and the PWM signal of the fixed duty is generated, but the torque of the LF motor 7 is controlled to be constant in the driving circuit 13'. Therefore, it is possible to drive each component of the sheet feeding apparatus by the stable motor torque, and the separation operation of separating the sheet from the sheet storage plate 2 can be stabilized.

Second Embodiment

Figure 7:
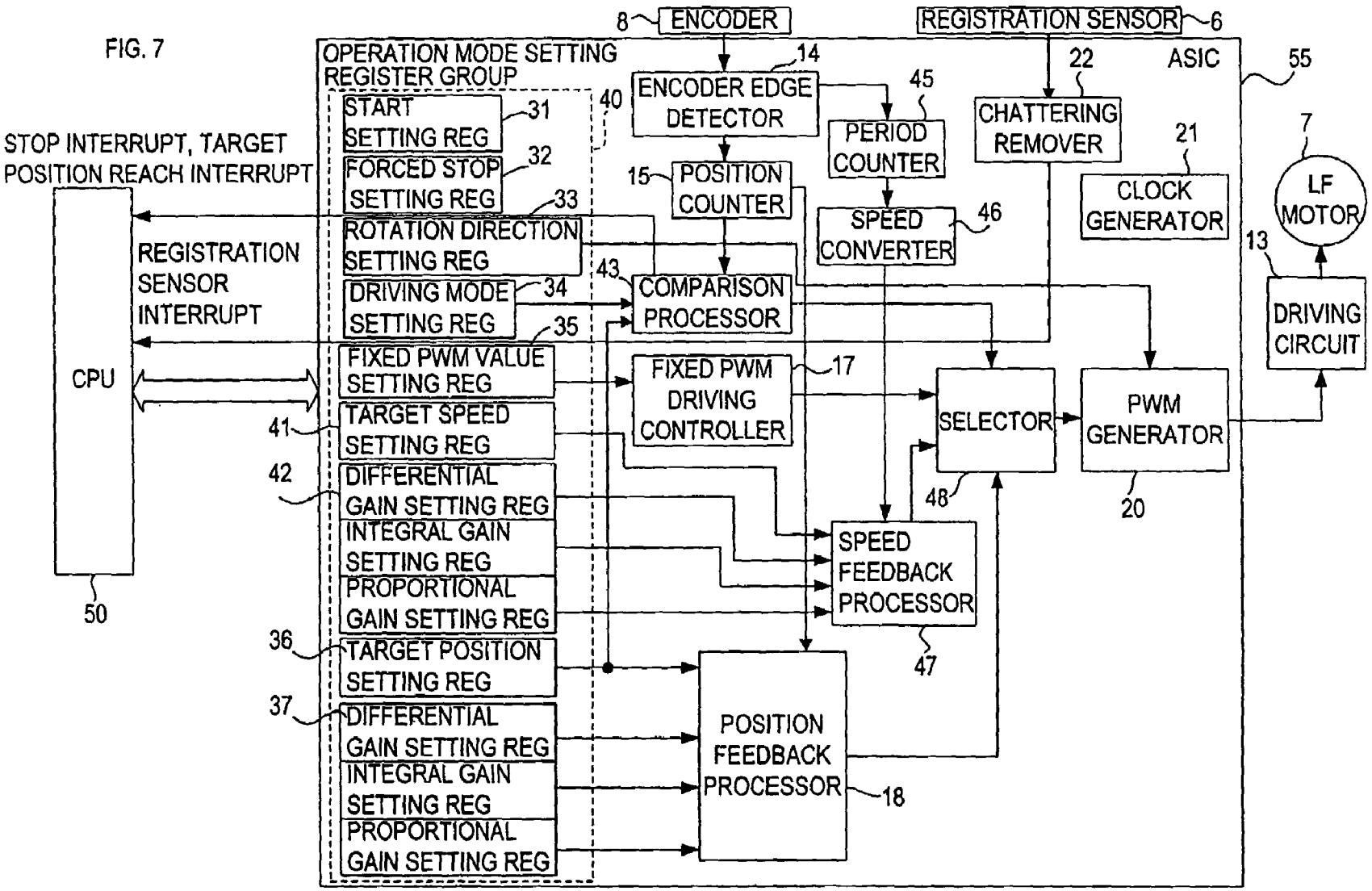
FIG. 7 is a block diagram showing the schematic constitution of the sheet feed control apparatus according to a second embodiment.

FIG. 7 shows the schematic constitution of the sheet feed control apparatus according to a second embodiment. As shown in FIG. 7, an ASIC 55 in the sheet feed control apparatus of the present embodiment is different from the ASIC 12 of the first embodiment shown in FIG. 3 in that a speed feedback processor 47 for performing the speed feedback control of the LF motor 7, a target speed setting register 41, and a gain setting register 42 are mainly disposed. Moreover, a period counter 45 and speed converter 46 are disposed to obtain the rotation speed of the LF motor 7 (i.e., the movement speed of the sheet) based on the pulse signal from the encoder 8.

The other respect is similar to the ASIC 12 of the first embodiment shown in FIG. 3. Therefore, the same constituting elements as those of FIG. 3 are denoted with the same reference numerals, and the description thereof is not repeated.

The target speed setting register 41 disposed in an operation mode setting register group 40 sets the transfer feed speed (hereinafter referred to simply as the "target speed") of the sheet. The gain setting register 42 sets the differential, integral, and proportional gains for use in the feedback computation during the speed feedback control of the rotation speed of the LF motor 7.

The speed feedback processor 47 also performs the computation processing, for example, based on the PID control, and controls the rotation speed of the LF motor 7 (the feed speed of the sheet) so that the speed coincides with the target speed in the same manner as in the position feedback processor 18. The period counter 45 obtains a period between the edges of the pulse signal of the encoder 8 which is detected by the encoder edge detector 14. The speed converter 46 converts the period between the edges to the speed. Moreover, a selector 48 selects the PWM value to be outputted to the PWM generator 20 from the fixed PWM driving controller 17, speed feedback processor 47, or position feedback processor 18 based on the set value of the driving mode setting register 34 inputted via a comparison processor 43.

In the sheet feed control apparatus constituted in this manner, the sheet feed process performed by a CPU 50 will be described with reference to FIG. 8. FIG. 8 is a flowchart showing the sheet feed process according to the second embodiment. It is to be noted that in the flowchart of FIG. 8, as compared with the sheet feed process of the first embodiment shown in FIG. 4, a process of S310 to S340 is added between S130 and S140 of FIG. 4.

When this process is started, first in S110, the driving mode setting register 34 is set to the fixed PWM driving mode. Subsequently, in S120, the register necessary for removing (separating) the sheet from the sheet storage plate 2 and feeding the sheet to the registration sensor detection position is set. The rotation direction setting register 33 is set to the reverse rotation, the fixed PWM value setting register 35 is set to the duty value of 40%, and further the target position setting register 36 is set to 1600 encoder counts. Subsequently in S130, when the start setting register 31 is set, the rotation of the LF motor 7 and the feeding of the sheet are started.

After the sheet feed start, in S310, it is determined whether or not the sheet has reached the target position (1600 encoder counts). This determination is also performed based on the result of the determination (presence/absence of the interrupt signal) by the comparison processor 43 based on the count value from the position counter 15. When the sheet reaches the target position and the interrupt signal is inputted into the CPU 50, the process shifts to S320 to set the driving mode to a speed feedback control mode. That is, the motor is first driven in the fixed PWM driving mode, but the mode is changed to the speed feedback control halfway.

Subsequently in S330, various register settings necessary for performing the speed feedback control are performed. The rotation direction is set to the reverse rotation, the target speed is set to 8 inches per second (ips), and the target position is set to 14400 encoder counts. Further the gain setting register 42 is set. Thereafter, in S340 the start setting is performed, and the driving of the LF motor 7 by the speed feedback control is started and continued until the sheet reaches the registration sensor detection position (until the determination in S140 becomes affirmative). Thereafter, since S140 and the subsequent steps are the same as those in the sheet feed process of FIG. 4 as described above, the description thereof is not repeated.

As described above, in the present embodiment, when the sheet is removed (separated) and fed by a predetermined amount, the motor is driven in the fixed PWM driving mode. Thereafter, the LF motor 7 is driven to the registration sensor detection position by the speed feedback control. It is to be noted that the position feedback control is performed in and after the registration sensor detection position in the same manner as in the first embodiment.

The speed feedback control is performed to the registration sensor detection position halfway in this manner, and thereby the rotation of the LF motor 7 (including the feeding of the sheet) is further speeded up.

It is to be noted that in the present embodiment a timing to change to the speed feedback control mode from the fixed PWM driving mode is determined based on the distance from a separation start time (1600 encoder counts in the above-described example), but this is not limited. For example, the time is measured from the separation start time. When a predetermined time elapses, the mode may also be changed to the speed feedback control mode.

Moreover, also in the present embodiment, in the same manner as in the first embodiment, the driving circuit 13' of FIG. 6 can be used instead of the driving circuit 13. That is, when the driving circuit 13' is used, a constant torque control is consequently realized to a first target position (1600 encoder counts) from the separation start time.

Third Embodiment

Figure 9:
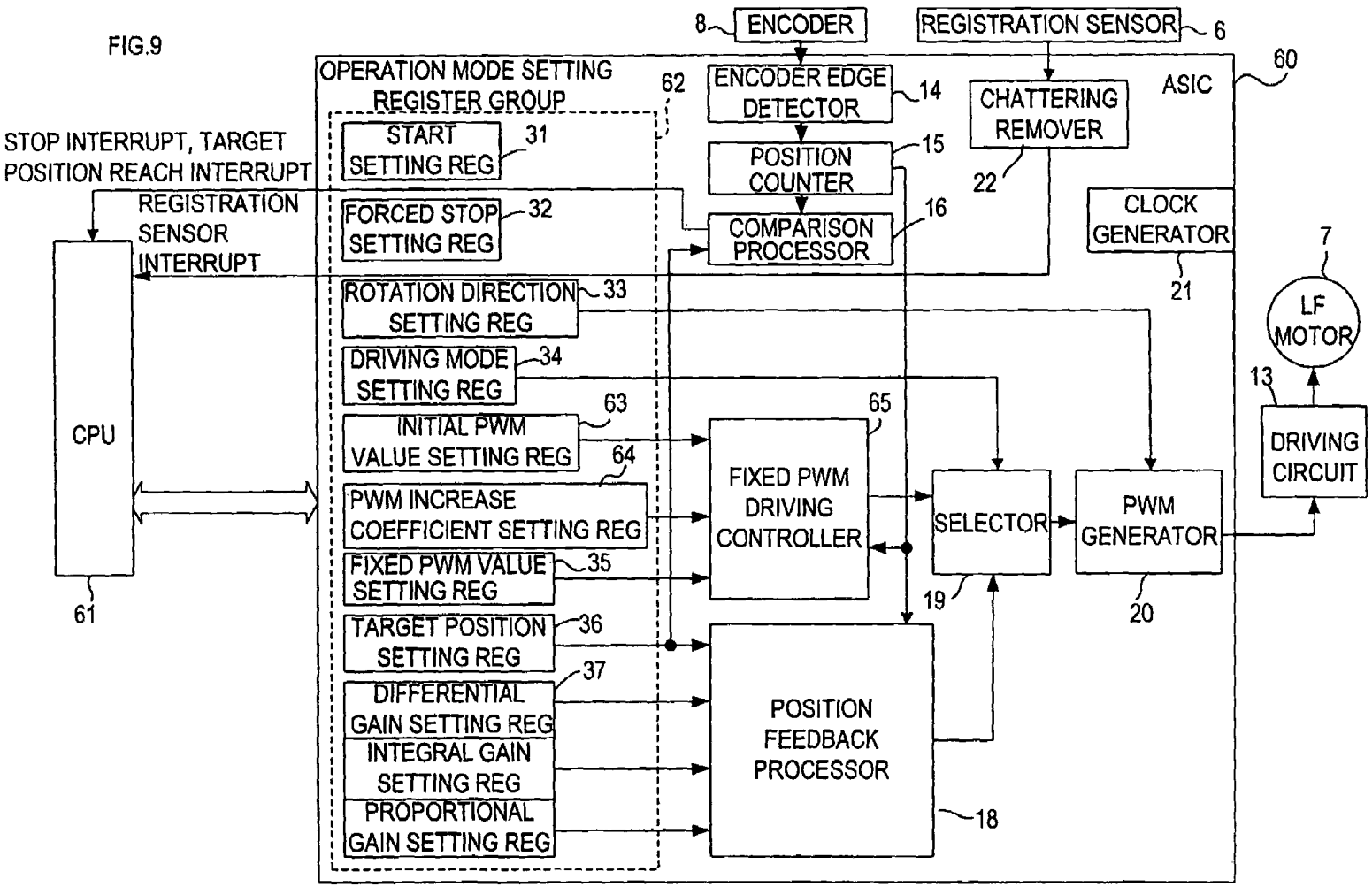
FIG. 9 is a block diagram showing the schematic constitution of the sheet feed control apparatus according to a third embodiment.

FIG. 9 shows the schematic constitution of the sheet feed control apparatus according to a third embodiment. As shown in FIG. 9, an ASIC 60 in the sheet feed control apparatus of the present embodiment is different from the ASIC 12 of the first embodiment shown in FIG. 3 in that an operation mode setting register group 62 includes an initial PWM value setting register 63 and PWM increase coefficient setting register 64 and that a fixed PWM driving controller 65 outputs the PWM value based on the set values of the respective registers 63, 64 and fixed PWM value setting register 85.

The other respect is similar to the ASIC 12 of the first embodiment shown in FIG. 3. Therefore, the same constituting elements as those of FIG. 3 are denoted with the same reference numerals, and the description thereof is not repeated.

The initial PWM value setting register 63 disposed in the operation mode setting register group 62 defines a first PWM duty value at the start time of the feeding (separating) of the sheet. The PWM increase coefficient setting register 64 defines a method of gradually increasing the first PWM duty value to a fixed PWM duty value.

That is, in the present embodiment, basically in the same manner as in the first embodiment, the LF motor 7 is driven to the registration position by the fixed PWM duty. However, the fixed PWM duty value is not used at the separation start time. Instead, the small duty is gradually increased finally to the fixed PWM duty value.

Figure 10:
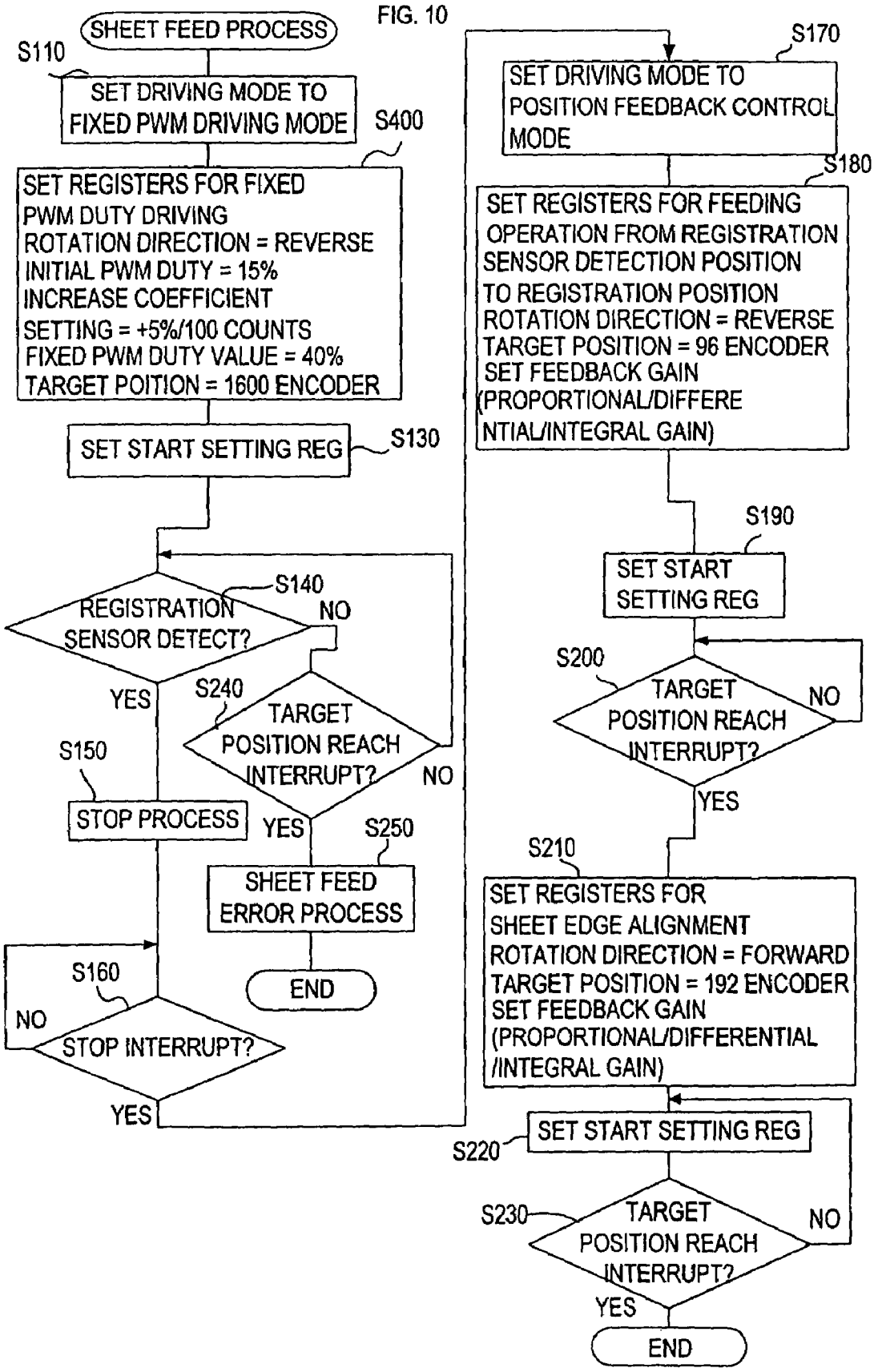
FIG. 10 is a flowchart showing the sheet feed process according to the third embodiment.

In the sheet feed control apparatus constituted in this manner, the sheet feed process performed by a CPU 61 will be described with reference to FIG. 10. FIG. 10 is a flowchart showing the sheet feed process according to the third embodiment. It is to be noted that in the flowchart of FIG. 10, as compared with the sheet feed process of the first embodiment shown in FIG. 4, only S120 of FIG. 4 is changed to S400 of FIG. 10. The other steps (S110, S130, and the subsequent steps) are the same as those of FIG. 4. Therefore, S400 in the third embodiment will be described, and the description of the other steps is not repeated.

As shown in FIG. 10, in the sheet feed process of the present embodiment, first in S110 the driving mode setting register 34 is set to the fixed PWM driving mode, and the process shifts to S400 to set various registers necessary for the fixed PWM duty driving. This process is similar to S120 of FIG. 4 in that the rotation direction is set to the reverse direction, the target position is set to 1600 encoder counts, and the fixed PWM duty value is set to 40% .

Further in the present embodiment, the initial PWM duty is set, for example, to 15%, and an increase coefficient (method of increasing the PWM duty) is set to "5%/100 counts". Thereby, when the LF motor 7 starts to be driven by the start setting of S130, first the motor is driven in a duty of 15% as the initial PWM duty. Thereafter, every time the count value of the position counter 15 indicates 100 counts, the duty increases by 5%. Subsequently, the duty increases to 40% which is the fixed PWM duty, and is then fixed at the duty (40%).

When the PWM duty is gradually increased at the separation start time in this manner, it is possible to smoothly separate the sheet. It is to be noted that in the present embodiment a period in which the duty of the PWM signal increases to the fixed PWM duty (40%) from the initial PWM duty (15%) corresponds to the driving start period of the present invention.

Moreover, even in the present embodiment, the driving circuit 13' of FIG. 6 can be used instead of the driving circuit 13. That is, with the use of the driving circuit 13', while the duty at the separation start time increases to the fixed PWM duty, the torque of the LF motor 7 consequently gradually increases.

It is to be noted that in this case the torque of the LF motor 7 at the duty indicating the initial PWM duty of 15% corresponds to the initial torque, and the torque of the LF motor 7 at the fixed PWM duty of 40% corresponds to the fixed torque.

Fourth Embodiment

Figure 11:
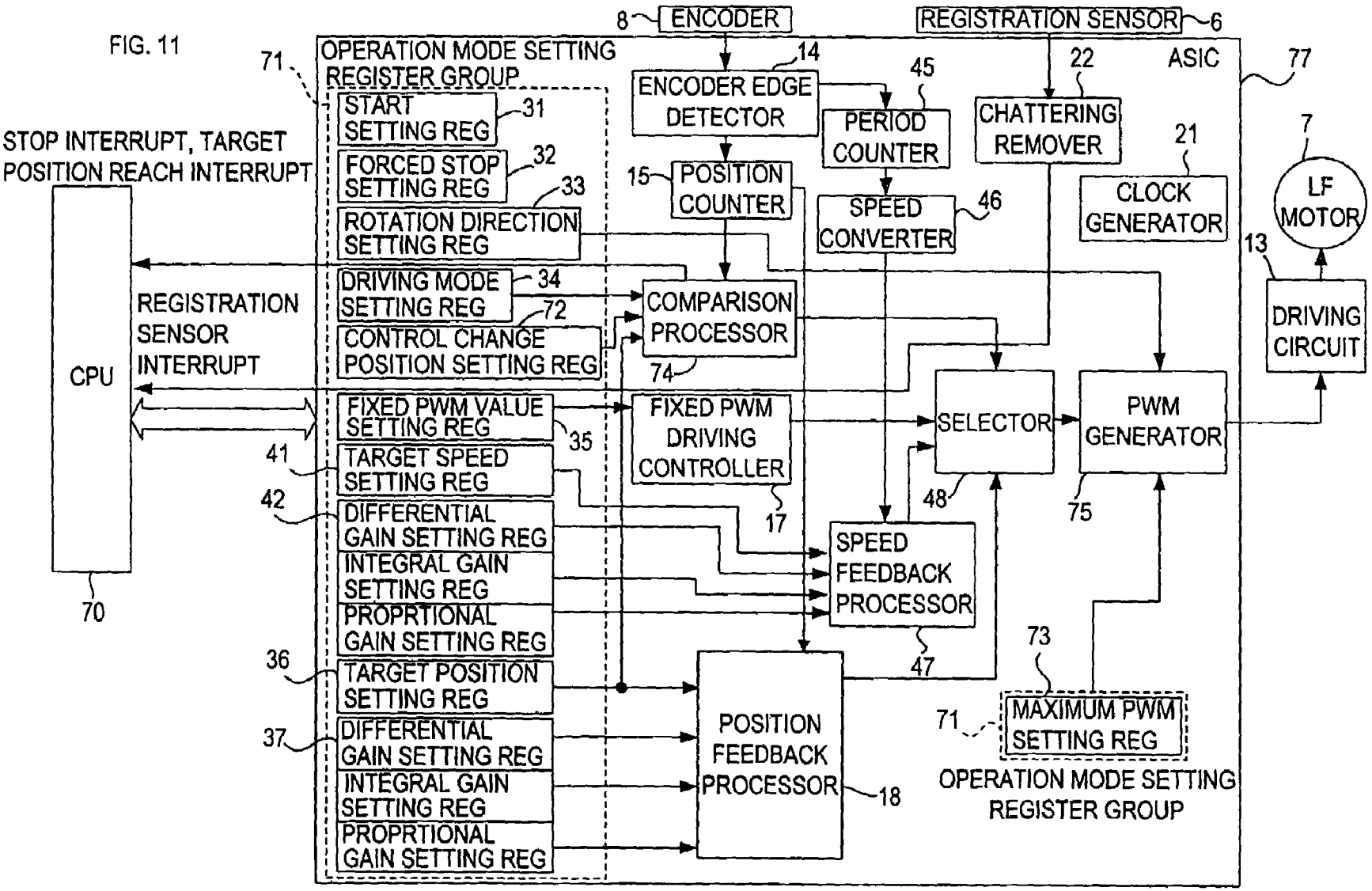
FIG. 11 is a block diagram showing the schematic constitution of the sheet feed control apparatus according to a fourth embodiment.

FIG. 11 shows the schematic constitution of the sheet feed control apparatus according to a fourth embodiment. As shown in FIG. 11, an ASIC 77 in the sheet feed control apparatus of the present embodiment is different from the ASIC 55 of the second embodiment shown in FIG. 7 mainly in that: an operation mode setting register group 71 includes a control change position setting register 72 which defines a change position for changing the control method in a certain position during the sheet feed; a comparison processor 74 informs the selector 48 of the position to change the control based on the set value of the control change position setting register 72; the group further includes a maximum PWM setting register 73 which defines the upper limit of the PWM duty; and a PWM generator 75 does not generate the PWM signal of the duty exceeding a maximum PWM duty set in the register 73.

In the sheet feed control apparatus constituted in this manner, the sheet feed process performed by a CPU 70 will be described with reference to FIG. 12. FIG. 12 is a flowchart showing the sheet feed process according to the present embodiment. It is to be noted that in the flowchart of FIG. 12, as compared with the sheet feed process of the first embodiment shown in FIG. 4, S120 of FIG. 4 is changed to S510 of FIG. 12, S180 of FIG. 4 is changed to S520 of FIG. 12, and S210 of FIG. 4 is changed to S530 of FIG. 12. The other steps are the same as those of FIG. 4. Therefore, S510, S520, and S530 in the present embodiment will be described, and the description of the other steps is not repeated.

As shown in FIG. 12, in the sheet feed process of the present embodiment, first in S110 the driving mode setting register 34 is set to the fixed PWM driving mode, and the process shifts to S510 to set various registers.

This process is similar to S120 of FIG. 4 with respect to the rotation direction, fixed PWM duty value, and target position. Additionally, in the present embodiment, the control change position setting register 72 sets the position for changing the control method (change to the speed feedback control in the present embodiment). The target position speed after the change to the speed feedback control is set in the target speed setting register 41. The upper limit of the duty of the PWM signal is set in the maximum PWM setting register 73. Various control gains in the speed feedback control are set in the gain setting register 42.

In this setting, the driving mode is changed to the speed feedback control mode from the fixed PWM driving mode in the target position. Moreover, the PWM generator 75 does not generate the PWM signal whose duty exceeds 90% based on the set content of the maximum PWM setting register 73.

Moreover, even in the process of S520 after the change (S170) to the position feedback control, not only the rotation direction, target position, and feedback gain but also the maximum PWM duty are set. Even in the transfer operation after the sheet is fed to the registration position, as shown in S530, the maximum PWM duty is set.

When the upper limit of the PWM duty is set in this manner, it is possible to prevent generation of problems that the excessively large current flows through the motor for a certain factor and the motor itself burns out and that the circuit and power source for driving the motor are destroyed.

Fifth Embodiment

Figure 13:
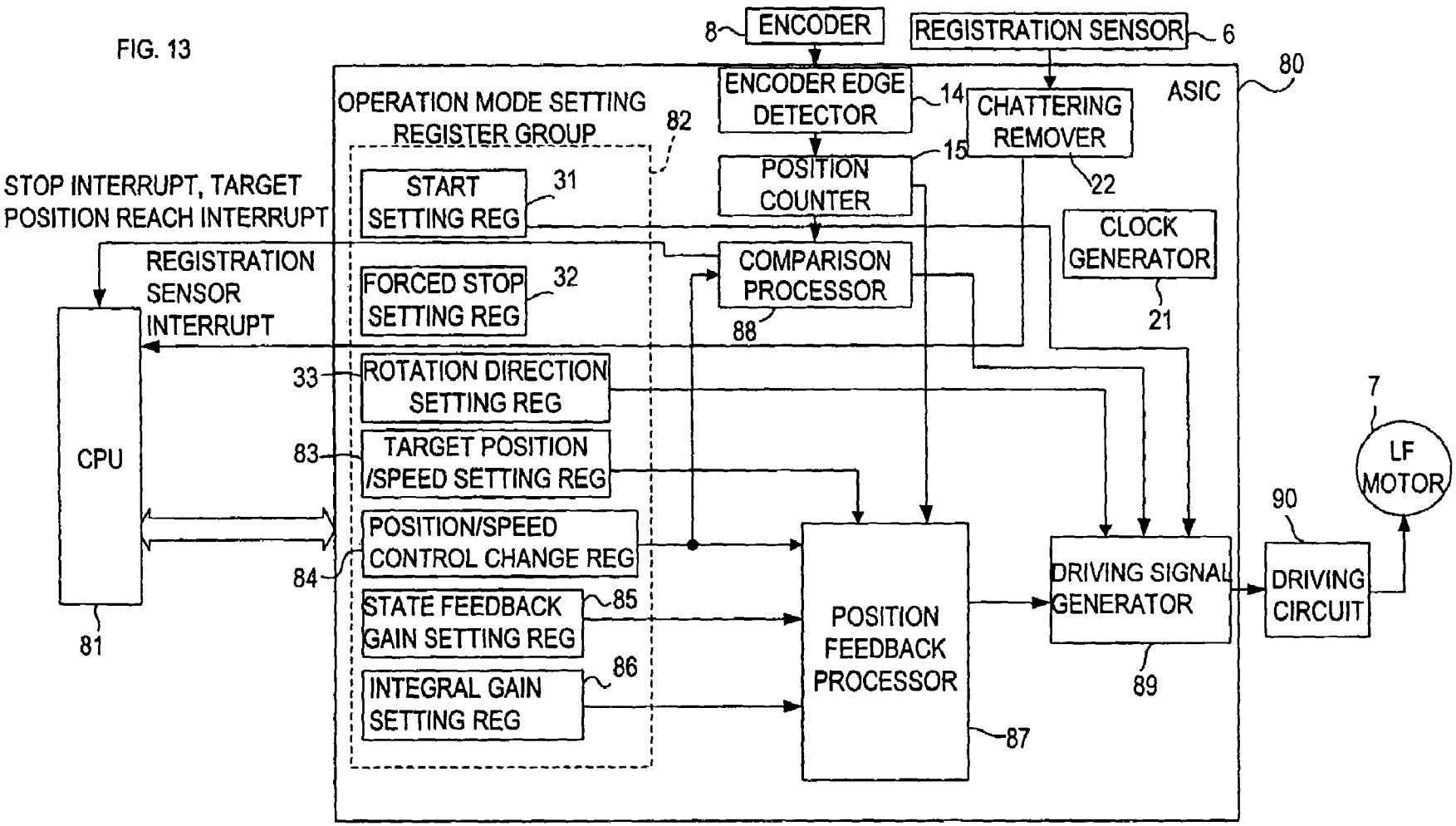
FIG. 13 is a block diagram showing the schematic constitution of the sheet feed control apparatus according to a fifth embodiment.

FIG. 13 shows the schematic constitution of the sheet feed control apparatus according to a fifth embodiment. As shown in FIG. 13, an ASIC 80 in the sheet feed control apparatus of the present embodiment includes: a target position/speed setting register 83, position/speed control change register 84, state feedback gain setting register 85, and integral gain setting register 86 disposed in an operation mode setting register group 82; comparison processor 88; state feedback processor 87; driving signal generator 89; and driving circuit 90. The other constituting elements are the same as those described above in any one of the first to fourth embodiments, and are therefore denoted with the same reference numerals as those of the above-described embodiments, and the description thereof is not repeated.

Figure 16:
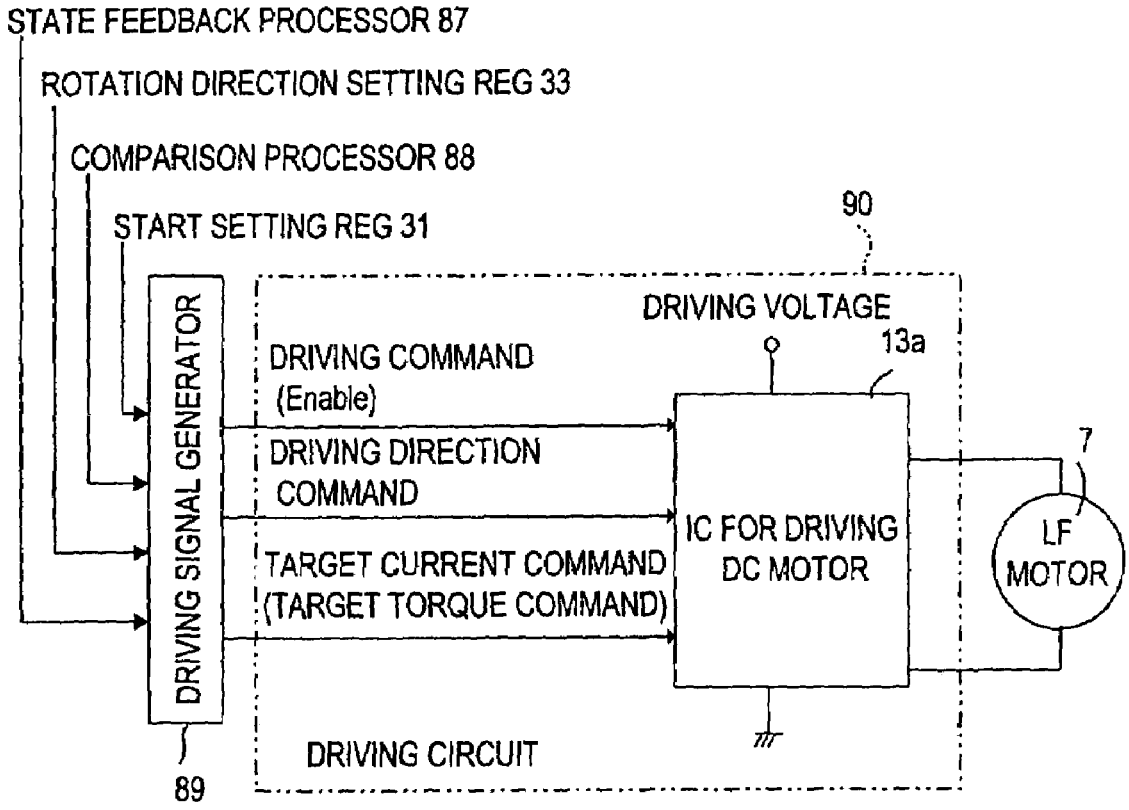
FIG. 16 is a block diagram showing the schematic constitution of the driving circuit.

First, the details of the driving circuit 90 of the present embodiment is as shown in FIG. 16. As compared with the driving circuit 13' described with reference to FIG. 6, the integration circuit including the resistances R1, R2 and capacitor C1 is not disposed, but the IC for driving the DC motor is the same.

On the other hand, the driving signal generator 89 generates and outputs the driving command based on the set value of the start setting register 31 and the output (presence/absence of count) from the comparison processor 88. Moreover, the signal generator 89 generates and outputs the driving direction command based on the set value of the rotation direction setting register 33. The generator is the same as the PWM generator 20*a* of FIG. 6 in this respect.

Moreover, the driving signal generator 89 generates and outputs the target current command (i.e., the target torque command) based on the control input (target current value in the present embodiment) generated and outputted by the state feedback processor 87. That is, different from the PWM generator 20*a* of FIG. 6 in which the PWM value is inputted from the selector 19 and which generates the PWM signal based on the value, the target current value is obtained by the state feedback processor 87. Therefore, the integration circuit of FIG. 6 is not necessary.

Next, for the target position/speed setting register 83 disposed in the operation mode setting register group 82, the target position at the position feed back control, and the target speed at the speed feedback time are set. The position/speed control change register 84 sets the method of the position feedback control or speed feedback control to drive the motor (i.e., the driving mode). The state feedback gain setting register 85 and integral gain setting register 86 set the gain for use in the computation processing in the state feedback processor 87, and this respect will be described later.

Figure 14:
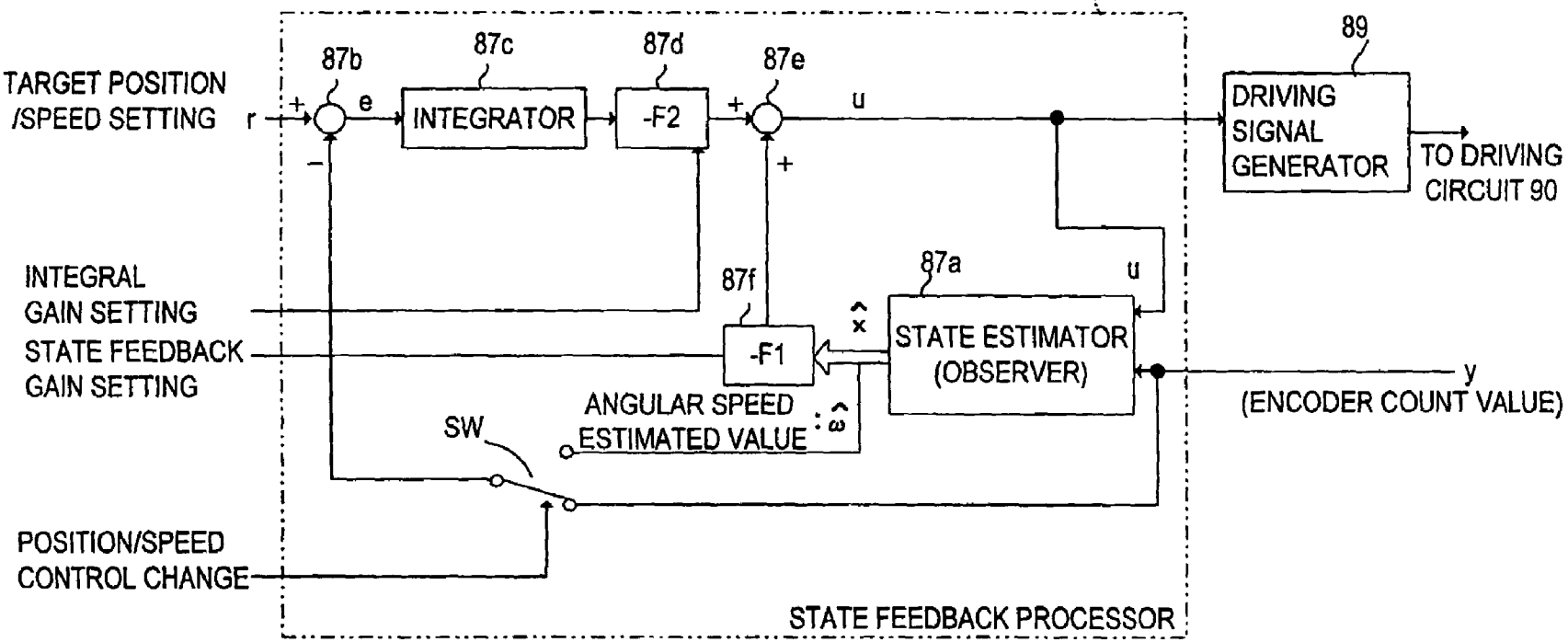
FIG. 14 is a block diagram showing the schematic constitution of a state feedback processor.

Next, the state feedback processor 87 will be described with reference to FIG. 14. FIG. 14 is a block diagram showing the schematic constitution of the state feedback processor 87. This state feedback processor 87 carries out the feedback control so that a count value y of the pulse signal of the encoder 8 obtained from the position counter 15 coincides with a target value r set in the target position/speed setting register 83. The state feedback processor 87 is constituted of a state estimator (observer) 87*a*, first adder 87*b*, integrator 87*c*, first gain accumulator 87*d*, second adder 87*e*, second gain accumulator 87*f*, and switch SW.

First, the first adder 87*b* calculates a deviation between the target value r set in the target position/speed setting register 83 and the count value y by the position counter 15 (in the position feedback control) or an angular speed estimated value ω which is one of state amounts estimated by the state estimator 87*a* described later (in the speed feedback control). Next, the integrator 87*c* calculates a value by discretely integrating the deviation calculated by the first adder 87*b*, that is, the accumulated value of the deviations. Subsequently, the first gain accumulator 87*d* accumulates the accumulated value calculated by the integrator 87*c* and an integral gain F2 set in the integral gain setting register 86 to generate a first control signal.

It is to be noted that the state estimator 87*a* carries out the calculation to realize a state feedback control, if a sheet feed system for feeding the sheet by the LF motor 7 is modeled as a dynamic linear system and is considered as a position servo system for controlling a feed amount when using an input current into the LF motor 7 as an operation amount. In this case, a state variable to select is not unique as described in the manual of state feedback, and therefore needs to appropriately be selected in accordance with a control system.

The encoder 8 can detect the rotation angle of the transfer roller 4 in the present embodiment. Therefore, a parameter by which the dynamic behavior of a driving object (load) is characterized, for example, a state amount x by which the angle and angular speed of the transfer roller 4 (load) are estimated are calculated. Additionally, to calculate the state amount x, a load resistance, and various parameters indicating mechanical constants such as inertia are used to derive a state equation. Therefore, the state estimator 87*a* calculates the state amount x based on the state equation.

Moreover, the state estimator 87*a* estimates the state amount x indicating the inner state of the sheet feeding apparatus based on a control input u (main control signal of the present invention) indicated by the control signal inputted in the driving signal generator 89 and the count value y by the position counter 15. Subsequently, the second gain accumulator 87*f* accumulates the state amount x estimated by the state estimator 87*a* and state feedback gain F1 set in the state feedback gain setting register 85 to generate a second control signal.

Moreover, the second adder 87*e* adds the first and second control signals to generate the control signal (control input u). In the present embodiment, the control input u is the target value of the current to be passed through the LF motor 7.

The switch SW is adapted to have a show state in the position feedback control mode in accordance with the set content of the position/speed control change register 84, and is changed from the shown state (i.e., switched on the output side of the state estimator 87*a*) in the speed feedback control mode.

In the present embodiment, the state estimator 87*a* can estimate various state amounts in this manner. Therefore, when the signal to be fed back on an input side is simply changed/selected with switch SW, the position feedback control and speed feedback control are realized with one control mechanism.

Next, the sheet feed process performed by a CPU 81 of the present embodiment will be described with reference to FIG. 15. In the sheet feed process of FIG. 15, the steps (S140 to S250) other than S610 to S660, S670, and S680 are the same as S140 to S250 (excluding S180 and S210) in the sheet feed process of the first embodiment described above with reference to FIG. 4. Therefore, the description of the steps is not repeated.

When this process is started, first in S610, the position/speed control change register 84 is set to the speed feedback control mode. Subsequently, in S620, the register necessary for removing (separating) the sheet from the sheet storage plate 2 and feeding the sheet to the registration sensor detection position is set. The rotation direction setting register 33, target position/speed setting register 83, state feedback gain setting register 85, and integral gain setting register 86 are set.

Subsequently in S630, the start setting register 31 is set, and thereby the rotating of the LF motor 7 and the feeding of the sheet are started.

After the sheet feeding is started, it is determined in S640 whether or not the sheet has reached the target position (1600 encoder). When the sheet reaches the target position and the interrupt signal indicating this is inputted, the process shifts to S650 to set the register again. Here, the target position and speed are set to those different from those of S620.

Thereafter, after the sheet reaches the registration sensor detection position, the setting is changed to the position feedback control mode (S170), and various registers for the position feedback control are set (S670). Subsequently, after the sheet reaches the registration position, and when the process shifts to the transfer operation, various registers for performing the desired position feedback control in the transfer operation are also set (S680), and the transfer operation is carried out.

As described above, in the present embodiment, different from the above-described embodiments in which the speed feedback processor is disposed separately from the position feedback processor, even when both the speed feedback control and position feedback control are carried out, it is unnecessary to dispose the control mechanism for each control method, and both the controls can be realized by one control mechanism (the state feedback processor 87 in the present embodiment). Therefore, the constitution of the whole apparatus can be simplified, and cost reduction is also possible.

Here, in the present embodiment, the state estimator 87*a* corresponds to the estimating portion of the present invention, and the second adder 87*e* corresponds to the main control signal generation portion of the present invention. Moreover, the first adder 87*b*, integrator 87*c*, and first gain accumulator 87*d* constitute the first control signal generation portion of the present invention.

It is to be noted that the embodiments of the present invention are not limited to the above-described embodiments, and can of course variously be modified within the technical scope of the present invention.

For example, when the sheets stored in the sheet storage plate 2 are taken out, the sheets can or cannot easily be taken out depending on the type of the sheet (e.g., a harder sheet cannot easily be taken out). To solve the problem, in the first to fourth embodiments, the fixed PWM duty value to be set in the fixed PWM value setting register 36 may also be changed with the type of the sheet.

Figure 17:
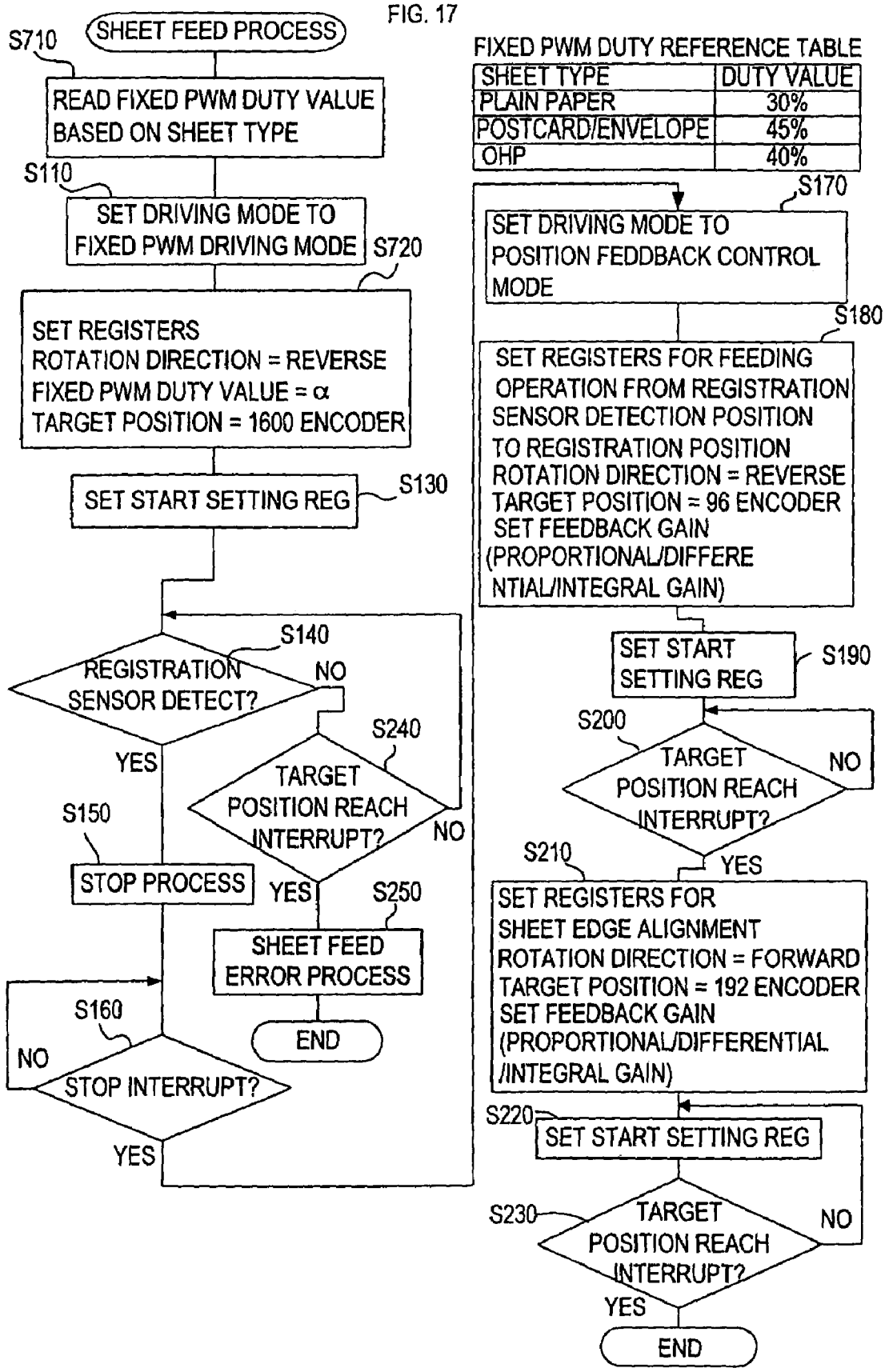
FIG. 17 is a flowchart showing a modification example of the sheet feed process according to the first embodiment.

In FIG. 17, in the sheet feed process of the first embodiment, the fixed PWM duty can be set in accordance with the type of the sheet. That is, as shown in FIG. 17, after this process is started, first in S710, the fixed PWM duty value based on the type of the sheet is read. A fixed PWM duty reference table as shown in FIG. 17 is stored beforehand in a memory (not shown), and the value is read from the memory.

Examples of a method of determining the type of the sheet include: a method of irradiating the sheet with light to determine the type based on a reflectance; and a method of operating a lever disposed in the printer 100 to select the sheet type by a user so that a signal may be inputted in the CPU 11 in response to the operation (i.e., in accordance with the sheet type). Various methods can be used as long as the CPU 11 can read the fixed PWM duty in accordance with the type of the sheet.

After the fixed PWM duty value is read in S710, the driving mode setting register 34 is set in S110. Subsequently in S720, various predetermined registers are set. In this case, the fixed PWM value setting register 35 is set based on the duty value read in S710. Since the steps (S130 and subsequent steps) after S720 are the same as S130 and the subsequent steps in FIG. 4 of the first embodiment, the description thereof is not repeated here.

Since the fixed PWM duty value can be set in accordance with the type of the sheet in this manner, the sheet can stably be taken out or fed out regardless of the type of the sheet. It is to be noted that FIG. 17 shows that the setting is applied to the sheet feed process of the first embodiment, but the value can similarly be set also in the second to fourth embodiments.

What is claimed is:

1. A sheet feeding apparatus comprising:

a sheet feeder that rotates a sheet feed roller in contact with sheets for printing by a motor to take out the sheets stored in a sheet storage unit sheet by sheet, and feeding the sheet to a predetermined registration position in which sheet transfer at a printing operation is started, said motor being a DC motor;

a controller that controls the rotating/driving of said motor to control the operation of said sheet feeder, an operation state detector that detects operation states of said motor or motor load driven by the motor; and a reference position detector that detects that said sheet fed by said sheet feeder has reached a predetermined reference position in a sheet feed path extending to said registration position from said sheet storage unit, said controller comprising:

a position control portion that performs a position feedback control to rotate/drive said motor in accordance with a deviation between the position of said sheet obtained based on said operation state detected by said operation state detector and a predetermined target position in a sheet feed end section from when said reference position detector detects that said sheet has reached said reference position until said sheet reaches said registration position; and a high-speed driving portion that rotates/drives said motor without performing said position feedback control to feed said sheet at a speed higher than a feed speed at a position feed back control in a sheet feed start section from when a sheet feed request is received from the outside until said reference position detector detects that said sheet has reached said reference position.

2. The sheet feeding apparatus according to claim 1, wherein said high-speed driving portion turns on/off a switching device disposed on an energizing path of said motor to drive said motor in response to a PWM signal of a preset fixed duty.

3. The sheet feeding apparatus according to claim 2, wherein said high-speed driving portion changes the fixed duty of said pulse signal in accordance with the type of said sheet.

4. The sheet feeding apparatus according to claim 2, wherein said high-speed driving portion increases the duty of said PWM signal to the fixed duty from an initial duty smaller than said fixed duty for a predetermined driving start period from the rotating/driving start of said motor, and holds said fixed duty after said driving start period.

5. The sheet feeding apparatus according to claim 2, wherein said controller comprises a duty limiting portion that limits said duty so that the duty does not exceed a preset upper limit value.

6. The sheet feeding apparatus according to claim 1, further comprising a current detector that detects an energizing current of said motor, wherein said high-speed driving portion performs a torque feedback control to rotate/drive the motor so that a torque of said motor obtained based on the energizing current detected by said current detector coincides with a preset target torque.

7. The sheet feeding apparatus according to claim 6, wherein said high-speed driving portion changes said target torque in accordance with the type of said sheet.

8. The sheet feeding apparatus according to claim 6, wherein said high-speed driving portion increases said target torque to the fixed torque from an initial torque smaller than a predetermined fixed torque for a predetermined driving start period from the rotating/driving start of said motor, and holds said fixed torque after said driving start period.

9. The sheet feeding apparatus according to claim 1, wherein said high-speed driving portion turns on/off a switching device disposed on an energizing path of said motor in response to a PWM signal of a preset fixed duty to drive said motor in a separation period from when said sheet feed roller starts rotating until one sheet is removed from said sheet storage unit, and performs a speed feedback control to rotate/drive said motor so that the feed speed coincides with a target speed in accordance with a deviation between the feed speed of said sheet obtained based on said operation state detected by said operation state detector and the preset target speed in a period until said reference position detector detects that said sheet has reached said reference position after said separation period.

10. The sheet feeding apparatus according to claim 9, wherein said high-speed driving portion changes the fixed duty of said pulse signal in accordance with the type of said sheet.

11. The sheet feeding apparatus according to claim 9, wherein said high-speed driving portion increases the duty of said PWM signal to the fixed duty from an initial duty smaller than said fixed duty for a predetermined driving start period from the rotating/driving start of said motor, and holds said fixed duty after said driving start period.

12. The sheet feeding apparatus according to claim 9, wherein said high-speed driving portion turns on/off the switching device disposed on the energizing path of said motor to perform said speed feedback control in response to the PWM signal of the predetermined duty in accordance with the deviation between the feed speed of said sheet and said target speed.

13. The sheet feeding apparatus according to claim 9, wherein said controller comprises a duty limiting portion that limits said duty so that the duty does not exceed a preset upper limit value.

14. The sheet feeding apparatus according to claim 1, further comprising:

a current detector that detects an energizing current of said motor, wherein said high-speed driving portion performs a torque feedback control to rotate/drive the motor so that a torque of said motor obtained based on the energizing current detected by said current detector coincides with a preset target torque in a separation period until one sheet is removed from said sheet storage unit after said sheet feed roller starts rotating, and performs a speed feedback control to rotate/drive said motor so that said feed speed coincides with a target speed in accordance with a deviation between the feed speed of said sheet obtained based on said operation state detected by said operation state detector and the preset target speed in a period until said reference position detector detects that said sheet has reached said reference position after said separation period.

15. The sheet feeding apparatus according to claim 14, wherein said high-speed driving portion changes said target torque in accordance with the type of said sheet.

16. The sheet feeding apparatus according to claim 14, wherein said high-speed driving portion increases said target torque to the fixed torque from an initial torque smaller than a predetermined fixed torque for a predetermined driving start period from the rotating/driving start of said motor, and holds said fixed torque after said driving start period.

17. The sheet feeding apparatus according to claim 14, wherein said high-speed driving portion turns on/off the switching device disposed on the energizing path of said motor to perform said speed feedback control in response to the PWM signal of the predetermined duty in accordance with the deviation between the feed speed of said sheet and said target speed.

18. The sheet feeding apparatus according to claim 17, wherein said controller comprises a duty limiting portion that limits said duty so that the duty does not exceed a preset upper limit value.

19. The sheet feeding apparatus according to claim 1, wherein said position control portion turns on/off the switching device disposed on the energizing path of said motor to perform said position feedback control in response to the PWM signal of the predetermined duty in accordance with the deviation between the position of said sheet and said target position.

20. The sheet feeding apparatus according to claim 19, wherein said controller comprises a duty limiting portion that limits said duty so that the duty does not exceed a preset upper limit value.

21. The sheet feeding apparatus according to claim 1, further comprising:

a transfer roller rotated by a driving force of said motor to transfer said sheet fed to said registration position by said sheet feed roller from the registration position so that a printing operation is performed; and a driving force transmission portion that transmits the rotation of said motor in a predetermined rotation direction for sheet feed to said sheet feed roller to rotate the sheet feed roller, and that transmits the rotation of the motor in a rotation direction for transfer reverse to said rotation direction for sheet feed to said transfer roller to rotate the transfer roller and stopping the rotation from being transmitted to said sheet feed roller, wherein, said controller further rotates said motor in said rotation direction for transfer to control said sheet transfer during the printing operation after said sheet is fed to said registration position.

22. The sheet feeding apparatus according to claim 21, wherein said controller continuously changes the rotation direction of said motor to said rotation direction for transfer from said rotation direction for sheet feed.

23. A sheet feeding apparatus comprising:

a sheet feeder that rotates a sheet feed roller in contact with sheets for printing by a motor to take out the sheets stored in a sheet storage unit sheet by sheet, and feeding the sheet to a predetermined registration position in which sheet transfer at a printing operation is started, said motor being a DC motor;

a controller that controls the rotating/driving of said motor to control the operation of said sheet feeder;

an operation state detector that detects operation states of said motor or motor load driven by the motor; and a reference position detector that detects that said sheet fed by said sheet feeder has reached a predetermined reference position in a sheet feed path extending to said registration position from said sheet storage unit, said controller comprises:

an estimating portion that estimates the state of said sheet feeder based on said operation state detected by said operation state detector and a main control signal outputted to said motor;

a first control signal generation portion that generates a first control signal based on a deviation between a predetermined control target value to control the operation of said sheet feeder and the operation state detected by said operation state detector or the state estimated by said estimating portion; and a main control signal generation portion that generates a main control signal based on said first control signal and a second control signal generated based on the state estimated by said estimating portion, and said main control signal generation portion generates the main control signal for performing a position feedback control to rotate/drive said motor so that the position of said sheet obtained based on said operation state detected by said operation state detector coincides with a predetermined target position in a sheet feed end section from when said reference position detector detects that said sheet has reached said reference position until said sheet reaches said registration position, and generates the main control signal for rotating/driving said motor without performing said position feedback control to generate the main control signal for feeding the sheet at the speed higher than the feed speed at a position feed back control in a sheet feed start section from when a sheet feed request is received until said reference position detector detects that said sheet has reached said reference position.

24. The sheet feeding apparatus according to claim 23, further comprising:

a transfer roller rotated by a driving force of said motor to transfer said sheet fed to said registration position by said sheet feed roller from the registration position so that a printing operation is performed; and a driving force transmission portion that transmits the rotation of said motor in a predetermined rotation direction for sheet feed to said sheet feed roller to rotate the sheet feed roller, and that transmits the rotation of the motor in a rotation direction for transfer reverse to said rotation direction for sheet feed to said transfer roller to rotate the transfer roller and stopping the rotation from being transmitted to said sheet feed roller, wherein, said controller further rotates said motor in said rotation direction for transfer to control said sheet transfer during the printing operation after said sheet is fed to said registration position.

25. The sheet feeding apparatus according to claim 24, wherein said controller continuously changes the rotation direction of said motor to said rotation direction for transfer from said rotation direction for sheet feed.

* * * * *